US011761203B2

(12) United States Patent
Curatolo et al.

(10) Patent No.: US 11,761,203 B2
(45) Date of Patent: Sep. 19, 2023

(54) MOLD-IN-PLACE CONCRETE FORMWORK

(71) Applicant: VISION PROFILE EXTRUSIONS LIMITED, Woodridge (CA)

(72) Inventors: Tony Curatolo, Woodridge (CA); Vic DeZen, Woodridge (CA); Mark Divito, Woodridge (CA); Christopher Jones, Woodridge (CA)

(73) Assignee: VISION PROFILE EXTRUSIONS LIMITED, Woodridge (CA)

( * ) Notice: Subject to any disclaimer, the term of this patent is extended or adjusted under 35 U.S.C. 154(b) by 0 days.

(21) Appl. No.: 17/147,206

(22) Filed: Jan. 12, 2021

(65) Prior Publication Data

US 2022/0220732 A1 Jul. 14, 2022

(51) Int. Cl.
*E04B 2/86* (2006.01)

(52) U.S. Cl.
CPC ..... *E04B 2/8629* (2013.01); *E04B 2002/867* (2013.01)

(58) Field of Classification Search
CPC ..... E04B 2/8629; E04B 2002/867
See application file for complete search history.

(56) References Cited

U.S. PATENT DOCUMENTS 5,247,773 A 9/1993 Weir
5,729,944 A 3/1998 De Zen
5,974,751 A 11/1999 De Zen
6,212,845 B1 4/2001 De Zen
6,293,063 B2 9/2001 Van Doren
6,658,808 B1 12/2003 Doherty et al.
9,441,365 B2 9/2016 Richardson et al.
2010/0212241 A1 8/2010 Holroyd
2016/0289960 A1* 10/2016 Darwell ..... E04C 2/36
2017/0175407 A1* 6/2017 Richardson ..... E04G 17/00
2018/0340332 A1* 11/2018 Johnston ..... E04G 17/001

* cited by examiner

*Primary Examiner* — Patrick J Maestri
(74) *Attorney, Agent, or Firm* — MARSHALL, GERSTEIN & BORUN LLP

(57) ABSTRACT

A plastic formwork is disclosed, and comprises a slurry-receiving structure, wherein the slurry-receiving structure defines an aperture and a formwork-defined internal space, wherein a slurry is receivable within the formwork-defined internal space. The formwork further comprises a formwork-defined first connection system counterpart and a formwork-defined second connection system counterpart, each of which includes a sealed interface-effecting portion that is supported by a substrate portion. The material of the sealed interface-effecting portion is softer than the material of the substrate portion. The formwork is connectible to another formwork via interlocking engagement with effect that an obtained aperture and an obtained internal space are obtained, wherein a slurry is receivable within the obtained internal space. The interlocking engagement is with effect that sealing engagement is effected between the sealed interface-effecting portions of the formwork and the another formwork such that sealed interfaces are obtained between the formwork and the another formwork.

23 Claims, 16 Drawing Sheets

MOLD-IN-PLACE CONCRETE FORMWORK

FIELD

The present disclosure relates to a formwork, in particular, to a formwork that is configured to connect with another formwork and effect a sealing engagement therebetween.

BACKGROUND

A formwork is used during construction, for example, of buildings, and defines an internal space into which concrete, slurry, and similar materials are poured and formed.

It may be desirable to connect multiple formworks in an end-to-end configuration to form a concrete slab of a relatively large size without having to manufacture a formwork having such a size. Unfortunately, existing formworks are connected together via sliding engagement. Accordingly, to connect two long formworks, for example, formworks that are 10 feet long, the first formwork would have to first be raised above the second formwork with connecting systems of the first formwork and second formwork aligned, for example. Due to the length of the formworks, raising the first formwork above the second formwork may be cumbersome and costly. For example, a scaffold may have to be constructed and used to raise the first formwork above the second formwork. Then, with the connecting system of the first and second formworks in alignment, the first formwork is lowered such that the connecting system is slidably received in the connecting system of the second formwork to slidingly engage the first formwork and the second formwork.

In addition, the connecting systems of the first formwork and the second formwork may not define a sufficient sealing interface therebetween, such that materials poured into the first and second formworks for setting may leak out.

Moreover, the bodies of existing formworks may obscure the internal space defined by the bodies of the existing formworks. To inspect the internal space of an existing formwork that has been installed, for example, prior to pouring in slurry into the internal space, an inspector may have to climb a ladder or scaffolding to look downward into the internal space. This may render inspection of the internal space difficult, and visibility of lower portions of the formwork may be reduced or absent, especially if the formwork is long, for example, 10 feet long

SUMMARY

In one aspect, there is provided a plastic formwork comprising: a slurry-receiving structure wherein: the slurry-receiving structure defines an aperture and a formwork-defined internal space, and; the aperture and the formwork-defined internal space are co-operatively configured such that a slurry is receivable within the formwork-defined internal space via the aperture; a formwork-defined first connection system counterpart, extending from the slurry-receiving structure, and including a sealed interface-effecting portion that is supported by a substrate portion, wherein the material of the sealed interface-effecting portion is softer than the material of the substrate portion; a formwork-defined second connection system counterpart, extending from the slurry-receiving structure, and including a sealed interface-effecting portion that is supported by a substrate portion, wherein the material of the sealed interface-effecting portion is softer than the material of the substrate portion; wherein: the formwork is connectible to another formwork via a first connection system and a second connection system with effect that an obtained aperture and an obtained internal space are obtained, wherein the obtained aperture and the obtained internal space are co-operatively configured such that a slurry is receivable within the obtained internal space via the obtained aperture; the formwork-defined first connection system counterpart is configured for co-operating with a first connection system counterpart of the another formwork, the first connection system including the formwork-defined first connection system counterpart and the first connection system counterpart of the another formwork, such that: (i) the connection to the another formwork via the first connection system includes interlocking engagement between the formwork-defined first connection system counterpart and the first connection system counterpart of the another formwork, and (ii) the interlocking engagement is with effect that a sealing engagement is effected between the sealed interface-effecting portion of the formwork-defined first connection system counterpart and the first connection system counterpart of the another formwork such that a sealed interface is obtained between the formwork-defined first connection system counterpart and the first connection system counterpart of the another formwork; and the formwork-defined second connection system counterpart is configured for co-operating with a second connection system counterpart of the another formwork, the second connection system including the formwork-defined second connection system counterpart and the second connection system counterpart of the another formwork, such that: (i) the connection to the another formwork via the second connection system includes interlocking engagement between the formwork-defined second connection system counterpart and the second connection system counterpart of the another formwork, and (ii) the interlocking engagement is with effect that a sealing engagement is effected between the sealed interface-effecting portion of the formwork-defined second connection system counterpart and the second connection system counterpart of the another formwork such that a sealed interface is obtained between the formwork-defined second connection system counterpart and the second connection system counterpart of the another formwork.

In another aspect, there is provided a plastic formwork comprising: a slurry-receiving structure wherein: the slurry-receiving structure defines an aperture and a formwork-defined internal space, and; the aperture and the formwork-defined internal space are co-operatively configured such that a slurry is receivable within the formwork-defined internal space via the aperture; a formwork-defined first connection system counterpart, extending from the slurry-receiving structure, and including a sealed interface-effecting portion that is supported by a substrate portion, wherein the material of the sealed interface-effecting portion is deformable in response to connection of the formwork with another formwork; a formwork-defined second connection system counterpart, extending from the slurry-receiving structure, and including a sealed interface-effecting portion that is supported by a substrate portion, wherein the material of the sealed interface-effecting portion is deformable in response to connection of the formwork with the another formwork; wherein: the formwork is connectible to the another formwork via a first connection system and a second connection system with effect that an obtained aperture and an obtained internal space are obtained, wherein the obtained aperture and the obtained internal space are co-operatively configured such that a slurry is receivable within the obtained internal space via the obtained aperture; the formwork-defined first connection system counterpart is configured for co-operating with a first connection system counterpart of the another formwork, the first connection system including the formwork-defined first connection system counterpart and the first connection system counterpart of the another formwork, such that: (i) the connection to the another formwork via the first connection system includes interlocking engagement between the formwork-defined first connection system counterpart and the first connection system counterpart of the another formwork, and (ii) the interlocking engagement is with effect that a sealing engagement is effected between the sealed interface-effecting portion of the formwork-defined first connection system counterpart and the first connection system counterpart of the another formwork such that a sealed interface is obtained between the formwork-defined first connection system counterpart and the first connection system counterpart of the another formwork; and the formwork-defined second connection system counterpart is configured for co-operating with a second connection system counterpart of the another formwork, the second connection system including the formwork-defined second connection system counterpart and the second connection system counterpart of the another formwork, such that: (i) the connection to the another formwork via the second connection system includes interlocking engagement between the formwork-defined second connection system counterpart and the second connection system counterpart of the another formwork, and (ii) the interlocking engagement is with effect that a sealing engagement is effected between the sealed interface-effecting portion of the formwork-defined second connection system counterpart and the second connection system counterpart of the another formwork such that a sealed interface is obtained between the formwork-defined second connection system counterpart and the second connection system counterpart of the another formwork.

In another aspect, there is provided a plastic formwork comprising: a first formwork-defining counterpart and a second formwork-defining counterpart, wherein the first formwork-defining counterpart and the second formwork-defining counterpart are connectible to obtain the formwork, with effect that a slurry-receiving structure is obtained, wherein: the slurry-receiving structure defines an aperture and a formwork-defined internal space, and; the aperture and the formwork-defined internal space are co-operatively configured such that a slurry is receivable within the formwork-defined internal space via the aperture; a formwork-defined first connection system counterpart, extending from the first formwork-defining counterpart, and including a sealed interface-effecting portion that is supported by a substrate portion, wherein the material of the sealed interface-effecting portion is softer than the material of the substrate portion; a formwork-defined second connection system counterpart, extending from the first formwork-defining counterpart, and including a sealed interface-effecting portion that is supported by a substrate portion, wherein the material of the sealed interface-effecting portion is softer than the material of the substrate portion; wherein: the formwork is connectible to another formwork via a first connection system and a second connection system with effect that an obtained aperture and an obtained internal space are obtained, wherein the obtained aperture and the obtained internal space are co-operatively configured such that a slurry is receivable within the obtained internal space via the obtained aperture; the formwork-defined first connection system counterpart is configured for co-operating with a first connection system counterpart of the another formwork, the first connection system including the formwork-defined first connection system counterpart and the first connection system counterpart of the another formwork, such that: (i) the connection to the another formwork via the first connection system includes interlocking engagement between the formwork-defined first connection system counterpart and the first connection system counterpart of the another formwork, and (ii) the interlocking engagement is with effect that a sealing engagement is effected between the sealed interface-effecting portion of the formwork-defined first connection system counterpart and the first connection system counterpart of the another formwork such that a sealed interface is obtained between the formwork-defined first connection system counterpart and the first connection system counterpart of the another formwork; and the formwork-defined second connection system counterpart is configured for co-operating with a second connection system counterpart of the another formwork, the second connection system including the formwork-defined second connection system counterpart and the second connection system counterpart of the another formwork, such that: (i) the connection to the another formwork via the second connection system includes interlocking engagement between the formwork-defined second connection system counterpart and the second connection system counterpart of the another formwork, and (ii) the interlocking engagement is with effect that a sealing engagement is effected between the sealed interface-effecting portion of the formwork-defined second connection system counterpart and the second connection system counterpart of the another formwork such that a sealed interface is obtained between the formwork-defined second connection system counterpart and the second connection system counterpart of the another formwork.

Other aspects will be apparent from the description and drawings provided herein.

BRIEF DESCRIPTION OF DRAWINGS

In the figures, which illustrate example embodiments.

DETAILED DESCRIPTION

Figure 1:
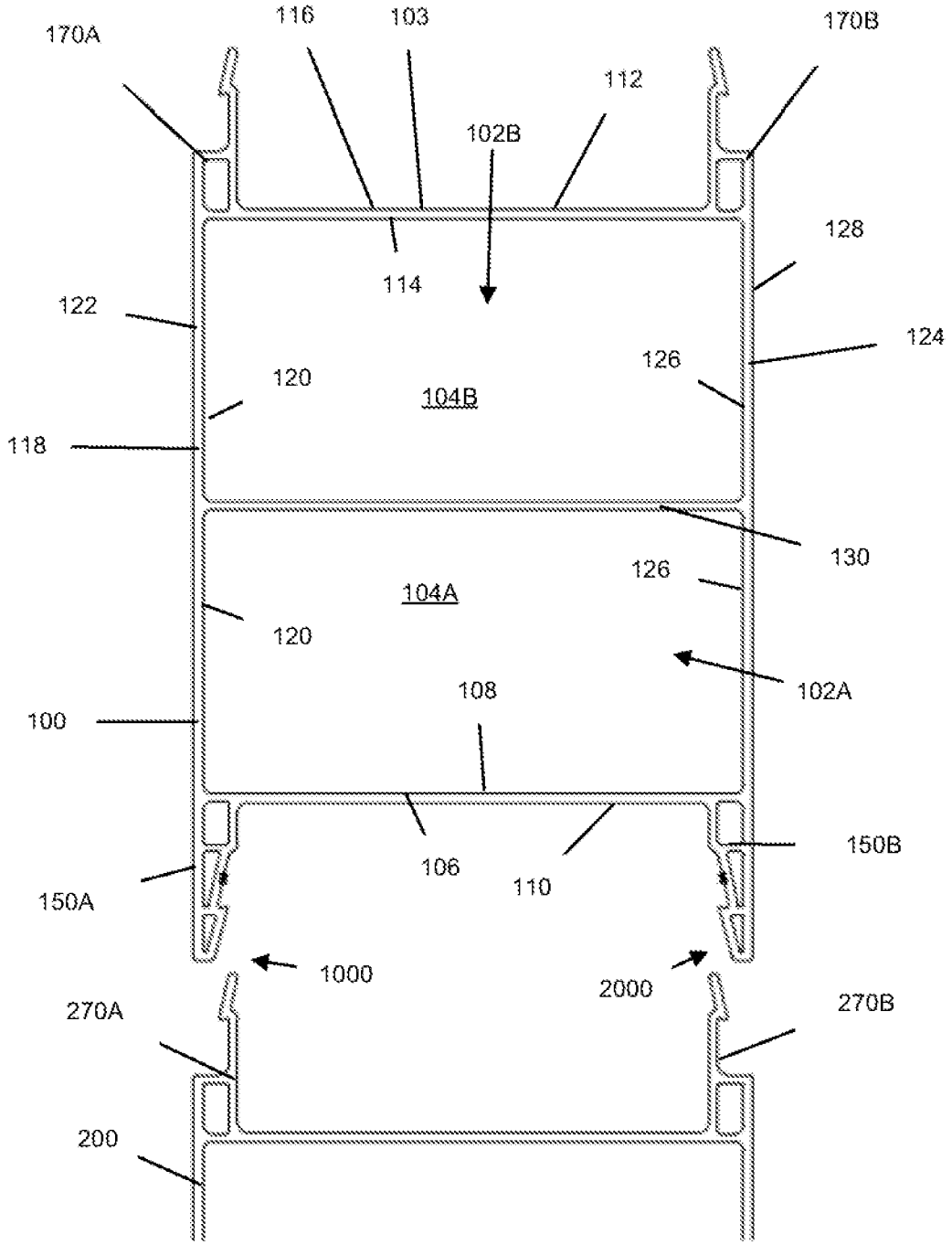
FIG. 1 is a top view of an embodiment of a formwork.

A plastic formwork that is connectible with another formwork with effect that an obtained aperture and an obtained internal space are obtained, and is configured to effect a sealing engagement with the another formwork and obtain a sealed interface between the formwork and the another formwork is disclosed. The formwork includes a formwork-defined first connection system counterpart and a formwork-defined second connection system counterpart. The formwork-defined first connection system counterpart and the formwork-defined second connection system counterpart extend from a slurry-receiving structure, and includes a substrate portion that supports (e.g. is joined to) a sealed interface-effecting portion. The sealed interface-effecting portion is configured to be deformable in response to abutment against another surface to effect a sealing engagement with said another surface, such that a sealed interface is obtained between the sealed interface-effecting portion and the surface against which the sealed interface-effecting portion is abutting.

In some embodiments, for example, the material of the sealed interface-effecting portions of the formwork-defined first and second connection system counterparts is different than the material of other portions of the formwork, for example, different than the material of the substrate portion or the material of an interlocking portion of a first connection system counterpart of a second formwork.

In some embodiments, the material of the sealed interface-effecting portion of the formwork-defined first connection system counterpart is softer or more deformable than the material of the rest of the formwork, for example, the material of the substrate portion. In some embodiments, the material of the sealed interface-effecting portion of the formwork-defined second connection system counterpart is softer or more deformable than the material of the rest of the formwork, for example, the material of the substrate portion.

The formwork is connectible with another formwork, such as a second formwork, via a first connection system and a second connection system, with effect that an obtained aperture and an obtained internal space are obtained. The obtained aperture and the obtained internal space are co-operatively configured such that a material, such as a slurry, concrete, and the like, is receivable within the obtained internal space via the obtained aperture, for example, for setting of the material.

The another formwork includes a first connection system counterpart of the another formwork and second connection system counterpart of the another formwork. The first connection system includes the formwork-defined first connection system counterpart and the first connection system counterpart of the another formwork, and the second connection system includes the formwork-defined second connection system counterpart and the second connection system counterpart of the another formwork.

The formwork-defined first connection system counterpart is configured for co-operating with the first connection system counterpart of the another formwork, such that: (i) the connection to the another formwork via the first connection system includes interlocking engagement between the formwork-defined first connection system counterpart and the first connection system counterpart of the another formwork, and (ii) the interlocking engagement is with effect that a sealing engagement is effected between the sealed interface-effecting portion of the formwork-defined first connection system counterpart and the first connection system counterpart of the another formwork such that a sealed interface is obtained between the formwork-defined first connection system counterpart and the first connection system counterpart of the another formwork.

The formwork-defined second connection system counterpart is configured for co-operating with the second connection system counterpart of the another formwork, such that: (i) the connection to the another formwork via the second connection system includes interlocking engagement between the formwork-defined second connection system counterpart and the second connection system counterpart of the another formwork, and (ii) the interlocking engagement is with effect that a sealing engagement is effected between the sealed interface-effecting portion of the formwork-defined second connection system counterpart and the second connection system counterpart of the another formwork such that a sealed interface is obtained between the formwork-defined second connection system counterpart and the second connection system counterpart of the another formwork.

In some embodiments, the sealed interface obtained between the formwork-defined first connection system counterpart and the first connection system counterpart of the another formwork, and the sealed interface obtained between the formwork-defined second connection system counterpart and the second connection system counterpart of the another formwork, are co-operatively configured to resist leakage of material received in the obtained internal space therebetween.

FIG. 1 depicts an example formwork 100. In some embodiments, the formwork 100 is a first formwork 100.

The formwork 100 includes a slurry-receiving structure 103 that defines an aperture 102 and a formwork-defined internal space 104. The aperture 102 is disposed in fluid communication with the formwork-defined internal space 104. The aperture 102 and the formwork-defined internal space 104 are co-operatively configured such that a material, such as slurry, concrete, and the like, is receivable within the formwork-defined internal space 104 via the aperture 102. In some embodiments, the formwork-defined internal space 104 is a channel that extends through the body of the formwork 100, such that a first aperture 102 is defined on a first side of the formwork 100, for example, a top side, and a second aperture 102 is defined on a second side of the formwork 100, for example, a bottom side, with the formwork-defined internal space 104 fluidly communicating the first and second apertures 102, as depicted in FIG. 1.

In some embodiments, for example, the formwork-defined internal space 104 is configured to contain the received slurry while the formwork 100 is supported on a planar base. In such embodiments, for example, while the formwork 100 is supported on the planar base, the planar base prevents flow of slurry out of the bottom aperture 102, such that slurry that is received within the formwork-defined internal space 104 is contained in the formwork-defined internal space 104.

In some embodiments, for example, the formwork 100 has a height of at least 1 foot, for example, 2 feet, for example, 6 feet, for example, 10 feet, for example, 12 feet.

In some embodiments, for example, the formwork-defined internal space 104 has a minimum volume of at least 0.005 $m^3$, for example, 0.05 $m^3$, for example, 0.1 $m^3$, for example, 0.2 $m^3$, for example, 0.3 $m^3$, for example, 0.4 $m^3$, for example, 0.5 $m^3$.

The body of the formwork 100, the aperture 102, and the formwork-defined internal space 104 is defined by one or more end walls and side walls of the formwork 100. In some embodiments, the aperture 102 and the formwork-defined internal space 104 are defined between end walls and side walls of the formwork 100.

As depicted in FIG. 1, the formwork 100 includes a first end wall 106 that has an inner surface 108 and an outer surface 110, a second end wall 112 having an inner surface 114 and an outer surface 116, a first side wall 118 having an inner surface 120 and an outer surface 122, and a second side wall 124 having an inner surface 126 and outer surface 128. As depicted, the first side wall 118 and the second side wall 124 extend between the first end wall 106 and the second end wall 112.

Figure 2:
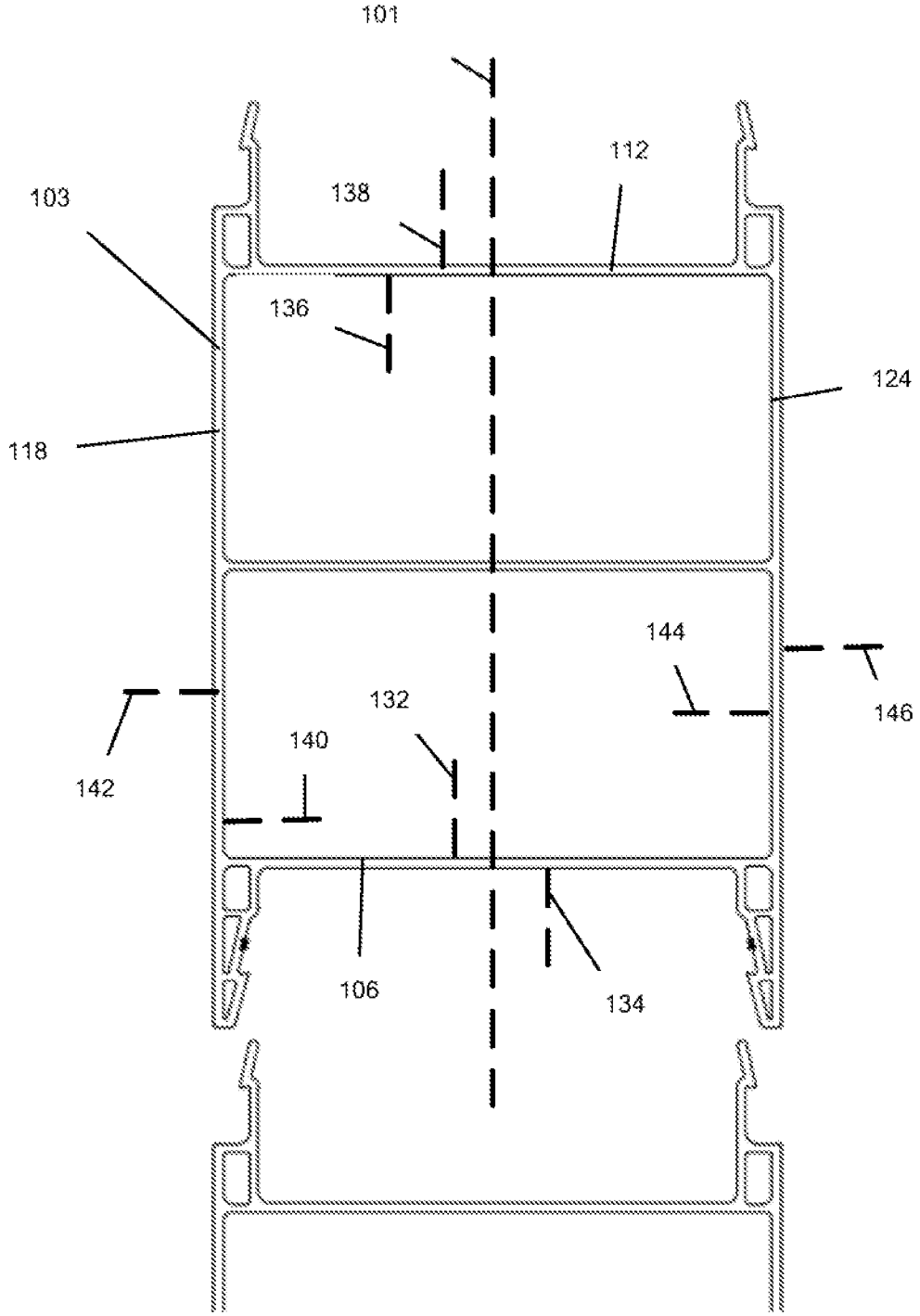
FIG. 2 is a top view of the formwork of FIG. 1, indicating the normal axes of the end walls and side walls.

In some embodiments, for example, the end walls and side walls of the formwork 100 define planar inner surfaces and planar outer surfaces. As depicted in FIG. 1 and FIG. 2, the first end wall 106 defines a planar inner surface 108 and a planar outer surface 110, the second end wall 112 defines a planar inner surface 114 and a planar outer surface 116, the first side wall 118 defines a planar inner surface 120 and a planar outer surface 122, and the second side wall 124 defines a planar inner surface 126 and a planar outer surface 128. In some embodiments, for example, the end walls and side walls of the formwork 100 define inner surfaces and outer surfaces having more than one planar surface, wherein at least one of said planar surfaces is non-parallel relative another one of said planar surfaces. In some embodiments, for example, the end walls and side walls of the formwork 100 define inner surfaces and outer surfaces wherein at least a portion of the inner surface and the outer surface is curved.

The first end wall 106, the second end wall 112, the first side wall 118, and the second side wall 124 define the shape of the body of the formwork 100, the aperture 102, and the formwork-defined internal space 104. As depicted, the first side wall 118 and the second side wall 124 are disposed perpendicularly relative to the first end wall 106 and the second end wall 112, such that the body of the formwork 100, the aperture 102, and the formwork-defined internal space 104 has a four-sided shape, such as a square shape or rectangular shape. In some embodiments, the formwork 100 has one or more end walls or side walls, and said end walls or side walls define the shape of the body of the formwork 100, the aperture 102, and the formwork-defined internal space 104 to be a round shape or have at least one curved surface (e.g. circle or oval), a two-sided shape, a three-sided shape (e.g. triangular shape), a four-sided shape (e.g. quadrilateral), or a shape having more than four sides (e.g. polygonal shape).

In some embodiments, for example, the formwork 100 includes one or more intermediate walls 130. In some embodiments, for example, the one or more intermediate walls 130 extends between an end wall to another end wall of the formwork 100, or between a side wall to another side wall of the formwork 100. As depicted in FIG. 1, the formwork 100 includes one intermediate wall 130 that extends between the first side wall 118 and the second side wall 124.

In some embodiments, for example, the intermediate wall 130 divides the aperture 104 and the formwork-defined internal space 104. As depicted in FIG. 1, the first end wall 106, the second end wall 112, the first side wall 118, the second side wall 124, and the intermediate wall 130 are co-operatively configured to define an aperture 102A, an aperture 102B, a formwork-defined internals space 104A, and a formwork-defined internal space 104B. As noted herein, the aperture 102A and the formwork-defined internal space 104A are co-operatively configured such that a material, such as slurry, concrete, and the like, is receivable within the formwork-defined internal space 104A via the aperture 102A. Similarly, the aperture 102B and the formwork-defined internal space 104B are co-operatively configured such that a material, such as slurry, concrete, and the like, is receivable within the formwork-defined internal space 104B via the aperture 102B. In some embodiments, for example, one or more intermediate walls 130 divide the aperture 102 and/or the formwork-defined internal space 104 into one or more apertures 102 and formwork-defined internal spaces 104.

As depicted in FIG. 1 and FIG. 2, the first end wall 106, the second end wall 112, the first side wall 118, and the second side wall 124 define planar inner surfaces and planar outer surfaces. As depicted, the inner surface 108 of the first end wall 106 defines a normal axis 132, the outer surface 110 of the first end wall 106 defines a normal axis 134, the inner surface 114 of the second end wall 112 defines a normal axis 136, the outer surface 116 of the second end wall 112 defines a normal axis 138, the inner surface 120 of the first side wall 118 defines a normal axis 140, the outer surface 122 of the first side wall 118 defines a normal axis 142, and the inner surface 126 of the second side wall 124 defines a normal axis 144, the outer surface 128 of the second side wall 124 defines a normal axis 146.

In some embodiments, for example, the normal axes 132 and 134 defined by the first end wall 106 are parallel to the normal axes 136 and 138 defined by the second end wall 112.

In some embodiments, for example, the normal axes 140 and 142 defined by the first side wall 118 are parallel to the normal axes 144 and 146 defined by the second side wall 124.

In some embodiments, for example, the normal axis 132 of the first end wall 106 is perpendicular to the normal axis 140 of the first side wall 118 and perpendicular to the normal axis 144 of the second side wall 124. In some embodiments, for example, the normal axis 136 of the second end wall 112 is perpendicular to the normal axis 140 of the first side wall 118 and perpendicular to the normal axis 144 of the second side wall 124.

In some embodiments, for example, the normal axis 134 of the first end wall 106 is perpendicular to the normal axis 142 of the first side wall 118 and perpendicular to the normal axis 146 of the second side wall 124. In some embodiments, for example, the normal axis 138 of the second end wall 112 is perpendicular to the normal axis 142 of the first side wall 118 and perpendicular to the normal axis 146 of the second side wall 124.

In some embodiments, for example, the normal axis 132 of the first end wall 106 is perpendicular to the normal axis 142 of the first side wall 118 and perpendicular to the normal axis 146 of the second side wall 124. In some embodiments, for example, the normal axis 136 of the second end wall 112 is perpendicular to the normal axis 142 of the first side wall 118 and perpendicular to the normal axis 146 of the second side wall 124.

In some embodiments, for example, the normal axis 134 of the first end wall 106 is perpendicular to the normal axis 140 of the first side wall 118 and perpendicular to the normal axis 144 of the second side wall 124. In some embodiments, for example, the normal axis 138 of the second end wall 112 is perpendicular to the normal axis 140 of the first side wall 118 and perpendicular to the normal axis 144 of the second side wall 124.

As depicted in FIG. 2, the formwork 100 defines a longitudinal axis 101 that extends along the length of the formwork 100. In some embodiments, for example, the longitudinal axis 101 extends generally parallel to the axes 132, 134, 136, and 138, and extends generally perpendicular to the axes 140, 142, 144, and 146.

The formwork 100 includes a formwork-defined connection system counterpart 150. As depicted in FIG. 1 and FIG. 2, the formwork 100 includes two formwork-defined connection system counterparts 150, namely, a formwork-defined first connection system counterpart 150A and a formwork-defined second connection system counterpart 150B, that are configured such that the formwork 100 is connectible to another formwork, such as a second formwork 200, via two connection systems, namely, a first connection system 1000 and a second connection system 2000. In some embodiments, for example, the formwork 100 includes more than two formwork-defined connection system counterparts 150, wherein the number of formwork-defined connection system counterparts 150 is based on the number of connection systems for connecting the first formwork 100 and the second formwork 200.

Figure 3:
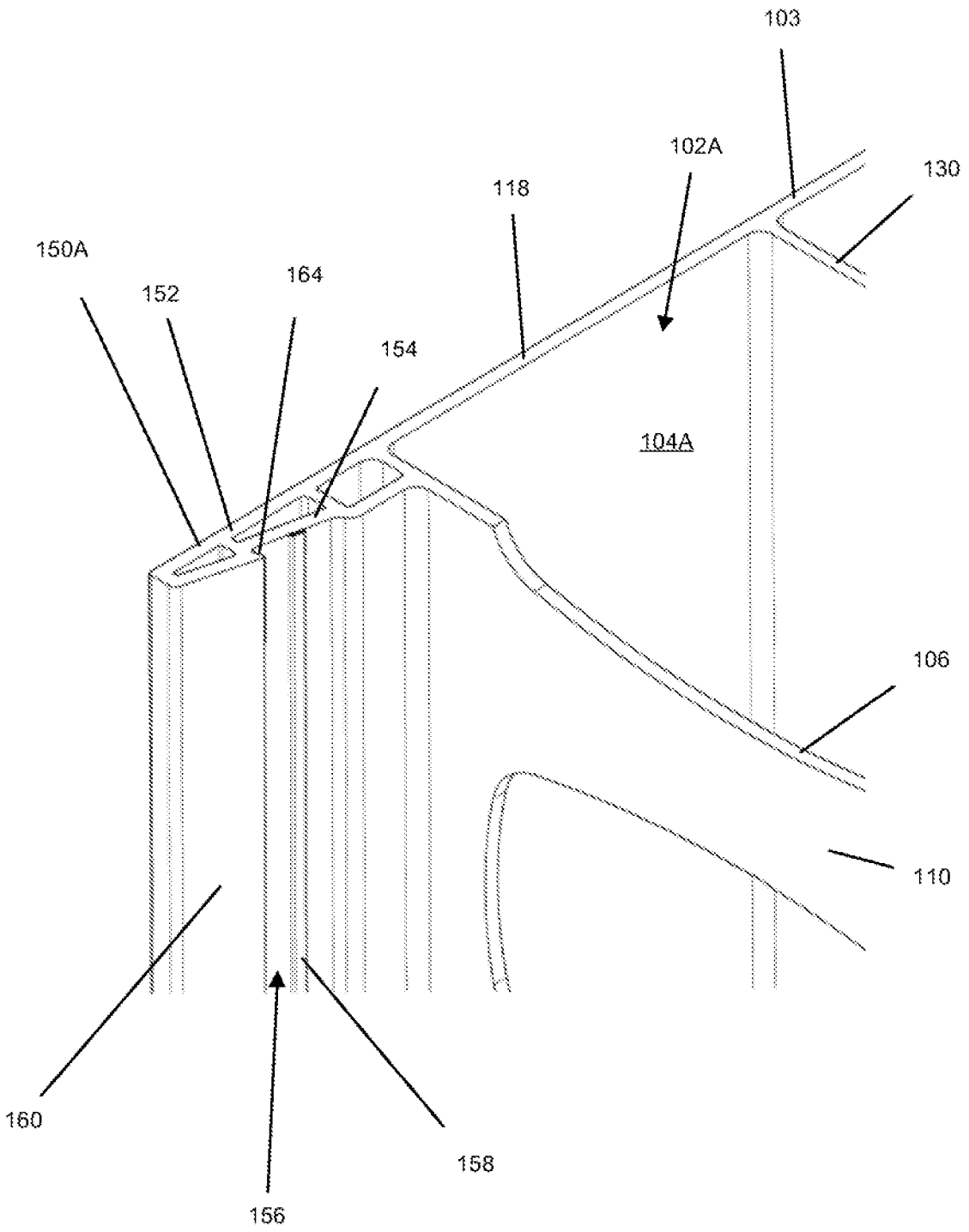
FIG. 3 is a perspective view of a formwork-defined first connection system counterpart of the formwork of FIG. 1.

FIG. 3 is a perspective view of a formwork-defined first connection system counterpart 150A, The formwork-defined first connection system counterpart 150A extends from the slurry-receiving structure 103. In some embodiments, for example, the formwork-defined first connection system counterpart 150A extends from an outermost surface of the formwork 100. In some embodiments, for example, the outermost surface of the formwork 100 is defined by an outer surface of an end wall or a side wall. As depicted in FIG. 1, FIG. 2, and FIG. 3, in some embodiments, for example, the outermost surface from which the formwork-defined first connection system counterpart 150A extends is the outer surface 110 of the first end wall 106.

As depicted in FIG. 3, in some embodiments, for example, the formwork-defined first connection system counterpart 150A includes a wall portion 152. In some embodiments, for example, the extension of the formwork-defined first connection system counterpart 150A, for example, the interlocking portion 160, from the slurry-receiving structure 103, is defined by the extension of the wall portion 152 from the slurry-receiving structure 103.

As depicted in FIG. 3, one end of the wall portion 152 is connected to the outer surface 110 of the first end wall 106. As depicted, in some embodiments, for example, the wall portion 152 is disposed in alignment with the first side wall 118. In some embodiments, for example, the wall portion 152 is disposed inwardly towards the longitudinal axis 101 on the outer surface 110 relative to the first side wall 118, such that the wall portion 152 and the first side wall 118 are not disposed in alignment.

In some embodiments, for example, as depicted in FIG. 3, the wall portion 152 extends perpendicularly from the outer surface 110. In some embodiments, for example, a normal axis defined by a wall surface of the wall portion 152 is perpendicular to the normal axis 134 defined by the outer surface 110 of the first end wall 106.

In some embodiments, for example, the formwork-defined first connection system counterpart 150A includes an interlocking portion 160 for effecting interlocking engagement with a first connection system counterpart 270A of the another formwork, for example, a second formwork 200. As depicted in FIG. 3, the interlocking portion 160 of the formwork defined first connection system counterpart 150A is connected to the wall portion 152, and is offset from the outer surface 110.

Figure 8:
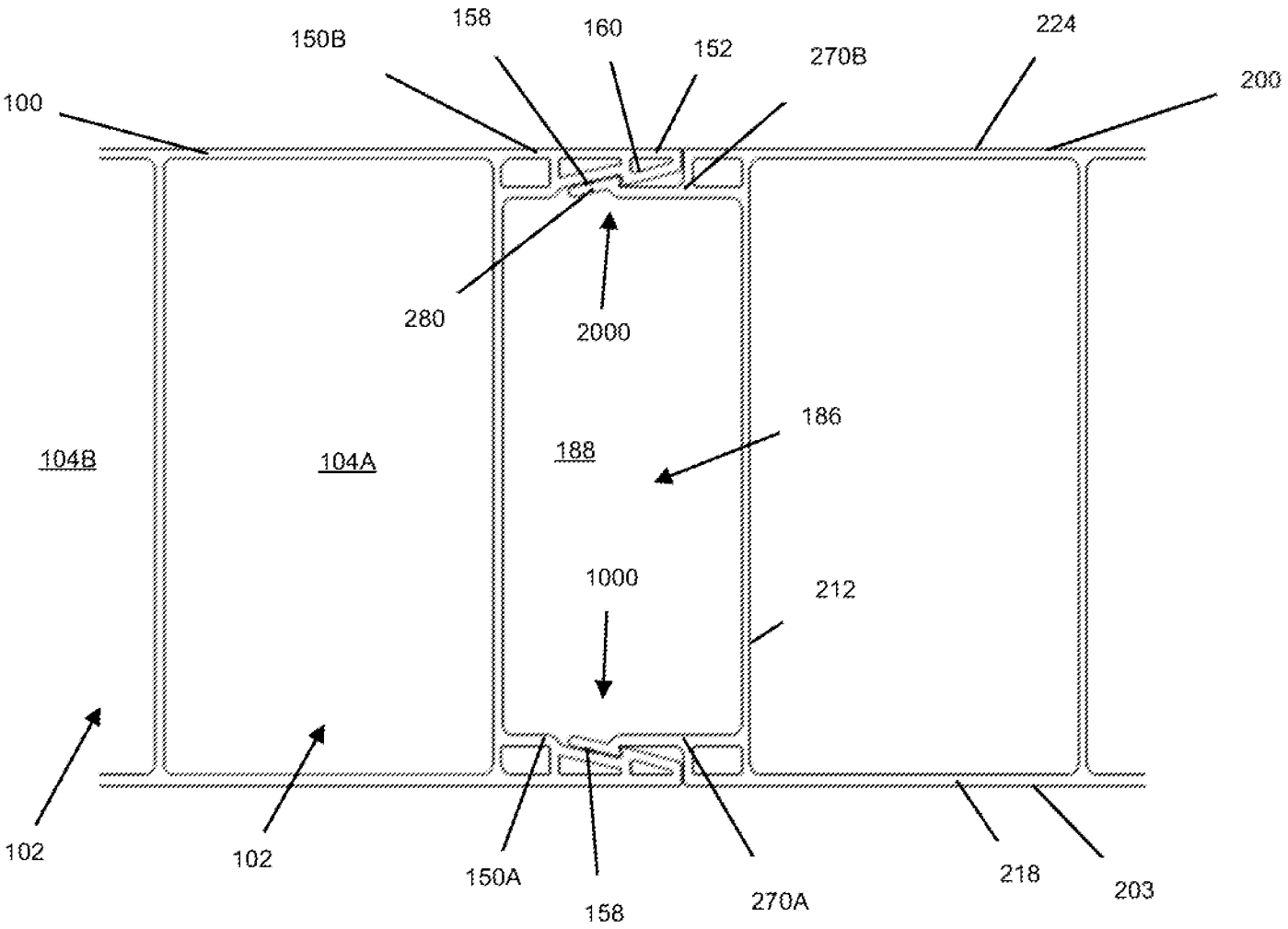
FIG. 8 is a top view of the first formwork connected to the second formwork of FIG. 7.

As depicted in FIG. 3, the interlocking portion 160 includes a substrate portion 154, which defines a recess 156 for receiving an interlocking portion 280 of a connection system counterpart 270, for example, a first connection system counterpart 270A, of a second formwork 200, as depicted in FIG. 8, as described in greater detail herein.

The formwork-defined first connection system counterpart 150A includes a sealed interface-effecting portion 158 that is supported by, for example, joined to, the substrate portion 154 and disposed in the recess 156. As depicted in FIG. 3, in some embodiments, for example, the sealed interface-effecting portion 158 has a rounded portion that extends away from the substrate portion 154. In some embodiments, for example, the sealed interface-effecting portion 158 is a sealing bead.

In some embodiments, for example, at least a portion of the sealed interface-effecting portion 158 is configured to be deformable in response to abutment against a surface to effect a sealing engagement with said surface, such that a sealed interface is obtained between the sealed interface-effecting portion 158 and the surface against which the sealed interface-effecting portion 158 is abutting.

As described in greater detail herein, while the first formwork 100 and the second formwork 200 are connected, the sealed interface-effecting portion 158 of the formwork-defined first connection system counterpart 150A is disposed in abutting engagement with an interlocking portion 280 of a first connection system counterpart 270A, such that a sealed interface 190 is obtained between the formwork-defined first connection system counterpart 150A of the first formwork 100 and the first connection system counterpart 270A of the second formwork 200. The sealed interface 190 obtained between the formwork-defined first connection system counterpart 150A and the first connection system counterpart 270A of the another formwork 200 is effected via deformation of the sealed interface-effecting portion 158 of the formwork-defined first connection system counterpart 150A.

In some embodiments, for example, the material of the sealed interface-effecting portion 158 of the formwork-defined first connection system counterpart 150A is different than the material of the rest of the formwork 100, for example, the material of the substrate portion 154. In some embodiments, for example, the material of the sealed interface-effecting portion 158 is softer or more deformable than the material of the substrate portion 154.

In some embodiments, for example, the sealed interface-effecting portion 158 is manufactured with flexible polyvinyl chloride (PVC), and the rest of the formwork 100, for example, the substrate portion 154, is manufactured with rigid PVC.

In some embodiments, for example, the material of the sealed interface-effecting portion 158 has a first compressive modulus, and the material of the substrate portion 154 has a second compressive modulus that is greater than the first compressive modulus. In some embodiments, for example, the first compressive modulus is at least 0.0005 GPa, for example, 0.01 GPa, for example, 0.5 GPa, for example, 0.9 GPa, for example, 1 GPa, for example, 3 GPa. In some embodiments, for example, the first compressive modulus is between 0.001 GPa and 1.8 GPa. In some embodiments, for example, the second compressive modulus is at least 2 GPa, for example, 2.4 GPa, for example, 4 GPa, for example, 6

GPa. In some embodiments, for example, the second compressive modulus is between 2.4 GPa and 4 GPa.

In some embodiments, for example, the material of the sealed interface-effecting portion 158 has a first shore hardness, and the material of the substrate portion 154 has a second shore hardness that is greater than the first shore harness. In some embodiments, for example, the first shore hardness is at least Shore 13D, for example, Shore 30D, for example, Shore 50D, for example, Shore 80D. In some embodiments, for example, the first shore hardness is between Shore 15D and Shore 70D. In some embodiments, for example, the second shore hardness is at least Shore 45D, for example, Shore 60D, for example, Shore 70D, for example, Shore 80D, for example, Shore 90D. In some embodiments, for example, the second shore hardness is between Shore 65D and Shore 90D.

In some embodiments, for example, the material of the sealed interface-effecting portion 158 of the formwork-defined first connection system counterpart 150A is different than the material of the first connection system counterpart 270A, for example, the interlocking portion 280 of the first connection system counterpart 270A. In some embodiments, for example, the material of the sealed interface-effecting portion 158 is softer or more deformable than the material of the first connection system counterpart 270A, for example, the interlocking portion 280 of the first connection system counterpart 270A.

In some embodiments, for example, the sealed interface-effecting portion 158 is manufactured with flexible PVC, and the first connection system counterpart 270A is manufactured with rigid PVC.

In some embodiments, for example, the material of the sealed interface-effecting portion 158 has a first compressive modulus, and the material of the first connection system counterpart 270A has a second compressive modulus that is greater than the first compressive modulus. In some embodiments, for example, the first compressive modulus is at least 0.0005 GPa, for example, 0.01 GPa, for example, 0.5 GPa, for example, 0.9 GPa, for example, 1 GPa, for example, 3 GPa. In some embodiments, for example, the first compressive modulus is between 0.001 GPa and 1.8 GPa. In some embodiments, for example, the second compressive modulus is at least 2 GPa, for example, 2.4 GPa, for example, 4 GPa, for example, 6 GPa. In some embodiments, for example, the second compressive modulus is between 2.4 GPa and 4 GPa.

In some embodiments, for example, the sealed interface-effecting portion 158 has a first shore hardness, and the first connection system counterpart 270A has a second shore hardness that is greater than the first shore hardness. In some embodiments, for example, the first shore hardness is at least Shore 13D, for example, Shore 30D, for example, Shore 50D, for example, Shore 80D. In some embodiments, for example, the first shore hardness is between Shore 15D and Shore 70D. In some embodiments, for example, the second shore hardness is at least Shore 45D, for example, Shore 60D, for example, Shore 70D, for example, Shore 80D, for example, Shore 90D. In some embodiments, for example, the second shore hardness is between Shore 65D and Shore 90D.

The interlocking portion 160 includes an abutment surface 164. In some embodiments, for example, as depicted in FIG. 3, the abutment surface 164 extends from the substrate portion 154. As described in greater detail herein, the abutment surface 164 of the interlocking portion 160 of the formwork-defined first connection system counterpart 150A functions to resist separation of the first formwork 100 and the second formwork 200 after the first formwork 100 and the second formwork 200 are connected.

In some embodiments, for example, the formwork-defined first connection system counterpart 150A is resilient, or includes one or more resilient portions, such that it is moveable between: (i) a first position for facilitating engagement of the formwork-defined first connection system counterpart 150A and the first connection system counterpart 270A such that one of the first formwork 100 and the second formwork 200 are displaceable towards the other of the first formwork 100 and the second formwork 200 while the formwork-defined first connection system counterpart 150A and the first connection system counterpart 270A are engaged, and (ii) a second position for retention of the formwork-defined first connection system counterpart 150A and the first connection system counterpart 270A.

Figure 4:
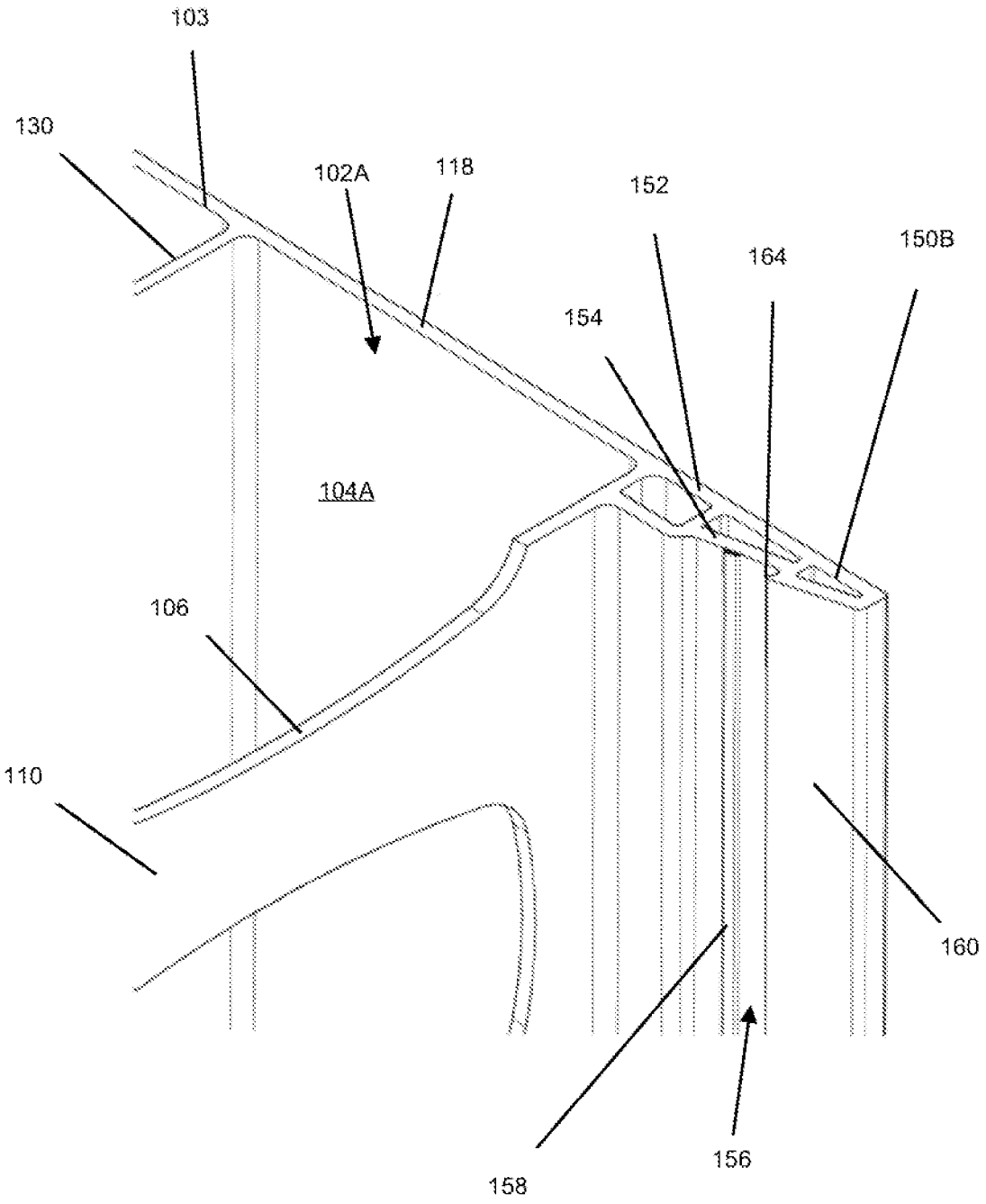
FIG. 4 is a perspective view of a formwork-defined second connection system counterpart of the formwork of FIG. 1.

FIG. 4 is a perspective view of a formwork-defined second connection system counterpart 150B.

The formwork-defined second connection system counterpart 150B extends from the slurry-receiving structure 103. In some embodiments, for example, the formwork-defined second connection system counterpart 150B extends from an outermost surface of the formwork 100. In some embodiments, for example, the outermost surface of the formwork 100 is defined by an outer surface of an end wall or a side wall. As depicted in FIG. 1, FIG. 2, and FIG. 4, in some embodiments, for example, the outermost surface from which the formwork-defined second connection system counterpart 150B extends is the outer surface 110 of the first end wall 106.

As depicted in FIG. 4, in some embodiments, for example, the formwork-defined second connection system counterpart 150B includes a wall portion 152. In some embodiments, for example, the extension of the formwork-defined second connection system counterpart 150B, for example, the interlocking portion 160, from the slurry-receiving structure 103, is defined by the extension of the wall portion 152 from the slurry-receiving structure 103. As depicted in FIG. 1 and FIG. 2, the wall portion 152 of the formwork-defined first connection system counterpart 150A and the formwork-defined second connection system counterpart 150B are disposed opposite to each other.

As depicted in FIG. 4, one end of the wall portion 152 is connected to the outer surface 110 of the first end wall 106. As depicted, in some embodiments, for example, the wall portion 152 is disposed in alignment with the first side wall 118. In some embodiments, for example, the wall portion 152 is disposed inwardly towards the longitudinal axis 101 on the outer surface 110 relative to the first side wall 118, such that the wall portion 152 and the first side wall 118 are not disposed in alignment.

In some embodiments, for example, as depicted in FIG. 4, the wall portion 152 extends perpendicularly from the outer surface 110. In some embodiments, for example, a normal axis defined by a wall surface of the wall portion 152 is perpendicular to the normal axis 134 defined by the outer surface 110 of the first end wall 106.

In some embodiments, for example, the formwork-defined second connection system counterpart 150B includes an interlocking portion 160 for effecting interlocking engagement with a second connection system counterpart 270B of the another formwork, for example, a second formwork 200. As depicted in FIG. 4, the interlocking portion 160 of the formwork-defined second connection system counterpart 150B is connected to the wall portion 152, and is offset from the outer surface 110.

As depicted in FIG. 4, the interlocking portion 160 includes a substrate portion 154, which defines a recess 156 for receiving an interlocking portion 280 of a connection system counterpart 270, for example, a second connection system counterpart 270B, of a second formwork 200, as depicted in FIG. 8, as described in greater detail herein.

The formwork-defined second connection system counterpart 150B includes a sealed interface-effecting portion 158 that is supported by, for example, joined to, the substrate portion 154 and disposed in the recess 156. As depicted in FIG. 4, in some embodiments, for example, the sealed interface-effecting portion 158 has a rounded portion that extends away from the substrate portion 154. In some embodiments, for example the sealed interface-effecting portion 158 is a sealing bead.

In some embodiments, for example, at least a portion of the sealed interface-effecting portion 158 is configured to be deformable in response to abutment against a surface to effect a sealing engagement with said surface, such that a sealed interface is obtained between the sealed interface-effecting portion 158 and the surface against which the sealed interface-effecting portion 158 is abutting.

As described in greater detail herein, while the first formwork 100 and the second formwork 200 are connected, the sealed interface-effecting portion 158 of the formwork-defined second connection system counterpart 150B is disposed in abutting engagement with an interlocking portion 280 of a second connection system counterpart 270B, such that a sealed interface 190 is obtained between the formwork-defined second connection system counterpart 150B of the first formwork 100 and the second connection system counterpart 270B of the second formwork 200. The sealed interface 190 obtained between the formwork-defined second connection system counterpart 150B and the second connection system counterpart 270B of the another formwork 200 is effected via deformation of the sealed interface-effecting portion 158 of the formwork-defined second connection system counterpart 150B.

In some embodiments, for example, the material of the sealed interface-effecting portion 158 of the formwork-defined second connection system counterpart 150B is different than the material of the rest of the formwork 100, for example, the material of the substrate portion 154. In some embodiments, for example, the material of the sealed interface-effecting portion 158 is softer or more deformable than the material of the substrate portion 154.

In some embodiments, for example, the sealed interface-effecting portion 158 is manufactured with flexible PVC, and the substrate portion 154 is manufactured with rigid PVC.

In some embodiments, for example, the material of the sealed interface-effecting portion 158 has a first compressive modulus, and the material of the substrate portion 154 has a second compressive modulus that is greater than the first compressive modulus. In some embodiments, for example, the first compressive modulus is at least 0.0005 GPa—for example, 0.01 GPa, for example, 0.5 GPa, for example, 0.9 GPa, for example, 1 GPa, for example 3 GPa. In some embodiments, for example, the first compressive modulus is between 0.001 GPa and 1.8 GPa. In some embodiments, for example, the second compressive modulus is at least 2 GPa, for example, 2.4 GPa, for example, 4 GPa, for example, 6 GPa. In some embodiments, for example, the second compressive modulus is between 2.4 GPa and 4 GPa.

In some embodiments, for example, the material of the sealed interface-effecting portion 158 has a first shore hardness, and the material of the substrate portion 154 has a second shore hardness that is greater than the first shore hardness. In some embodiments, for example, the first shore hardness is at least Shore 13D, for example, Shore 30D, for example, Shore 50D, for example, Shore 80D. In some embodiments, for example, the first shore hardness is between Shore 15D and Shore 70D. In some embodiments, for example, the second shore hardness is at least Shore 45D, for example, Shore 60D, for example, Shore 70D, for example, Shore 80D, for example, Shore 90D. In some embodiments, for example, the second shore hardness is between Shore 65D and Shore 90D.

In some embodiments, for example, the material of the sealed interface-effecting portion 158 of the formwork-defined second connection system counterpart 150B is different than the material of the second connection system counterpart 270B, for example, the interlocking portion 280 of the second connection system counterpart 270B. In some embodiments, for example, the material of the sealed interface-effecting portion 158 is softer or more deformable than the material of the second connection system counterpart 270B, for example, the interlocking portion 280 of the second connection system counterpart 270B.

In some embodiments, for example, the sealed interface-effecting portion 158 is manufactured with flexible PVC, and the second connection system counterpart 270B is manufactured with rigid PVC.

In some embodiments, for example, the material of the sealed interface-effecting portion 158 has a first compressive modulus, and the material of the second connection system counterpart 270B has a second compressive modulus that is greater than the first compressive modulus. In some embodiments, for example, the first compressive modulus is at least 0.0005 GPa, for example, 0.01 GPa, for example, 0.5 GPa, for example, 0.9 GPa, for example, 1 GPa, for example, 3 GPa. In some embodiments, for example, the first compressive modulus is between 0.001 GPa and 1.8 GPa. In some embodiments, for example, the second compressive modulus is at least 2 GPa, for example, 2.4 GPa, for example, 4 GPa, for example, 6 GPa. In some embodiments, for example, the second compressive modulus is between 2.4 GPa and 4 GPa.

In some embodiments, for example, the sealed interface-effecting portion 158 has a first shore hardness, and the second connection system counterpart 270B has a second shore hardness that is greater than the first shore hardness. In some embodiments, for example, the first shore hardness is at least Shore 13D, for example, Shore 30D, for example, Shore 50D, for example, Shore 80D. In some embodiments, for example, the first shore hardness is between Shore 15D and Shore 70D. In some embodiments, for example, the second shore hardness is at least Shore 45D, for example, Shore 60D, for example, Shore 70D, for example, Shore 80D, for example, Shore 90D. In some embodiments, for example, the second shore hardness is between Shore 65D and Shore 90D.

The interlocking portion 160 includes an abutment surface 164. In some embodiments, for example, as depicted in FIG. 4, the abutment surface 164 extends from the substrate portion 154. As described in greater detail herein, the abutment surface 164 of the interlocking portion 160 of the formwork-defined second connection system counterpart 150B functions to resist separation of the first formwork 100 and the second formwork 200 after the first formwork 100 and the second formwork 200 are connected.

In some embodiments, for example, the formwork-defined second connection system counterpart 150B is resilient, or includes one or more resilient portions, such that it is moveable between: (i) a first position for facilitating engagement of the formwork-defined second connection system counterpart 150B and the second connection system counterpart 270B such that one of the first formwork 100 and the second formwork 200 are displaceable towards the other of the first formwork 100 and the second formwork 200 while the formwork-defined second connection system counterpart 150B and the second connection system counterpart 270B are engaged, and (ii) a second position for retention of the formwork-defined second connection system counterpart 150B and the second connection system counterpart 270B.

In some embodiments, for example, the formwork-defined first connection system counterpart 150A, the formwork-defined second connection counterpart 150B, and the end wall from which they extend, such as the first end wall 106, are co-operatively configured such that, while the first formwork 100 and the second formwork 200 are co-operatively disposed for connection, the formwork-defined first connection system counterpart 150A and the formwork-defined second connection system counterpart 150B of the first formwork 100 extend from the end wall 106 such that the formwork-defined first connection system counterpart 150A and the formwork-defined second connection system counterpart 150B, for example, the interlocking portions 160, are aligned with the corresponding first connection system counterpart 270A and the second connection system counterpart 270B of the second formwork 200, for example, the interlocking portions 280, such that the formwork-defined first connection system counterpart 150A and the formwork-defined second connection system counterpart 150B, for example, the interlocking portions 160, of the first formwork 100 are engageable with the corresponding first connection system counterpart 270A and the second connection system counterpart 270B, for example, the interlocking portions 280, of the second formwork 200.

In some embodiments, for example, the formwork-defined first connection system counterpart 150A and the formwork-defined second connection system counterpart 150B extend from a wall of the formwork 100, such as the first end wall 106, such that, while the first formwork 100 and the second formwork 200 are co-operatively disposed for connection, the formwork-defined first connection system counterpart 150A and the formwork-defined second connection system counterpart 150B, for example, the interlocking portions 160, are aligned with the corresponding first connection system counterpart 270A and the second connection system counterpart 270B,f or example, the interlocking portions 280, of the second formwork 200, such that the formwork-defined first connection system counterpart 150A and the formwork-defined second connection system counterpart 150B, for example, the interlocking portions 160, of the first formwork 100 are engageable with the corresponding first connection system counterpart 270A and the second connection system counterpart 270B, for example, the interlocking portions 280, of the second formwork 200.

In some embodiments, for example, the formwork-defined first connection system counterpart 150A and the formwork-defined second connection system counterpart 150B extend generally perpendicularly from the first end wall 106.

The formwork 100 includes a formwork-defined connection system counterpart 170. As depicted in FIG. 1 and FIG. 2, the formwork 100 includes two formwork-defined connection system counterparts 170, namely, a formwork-defined third connection system counterpart 170A and a formwork-defined fourth connection system counterpart 170B, that are configured such that the formwork 100 is connectible to another formwork, such as a third formwork 300, via two connection systems, namely, a third connection system 3000 and a fourth connection system 4000. In some embodiments, for example, the formwork 100 includes more than two formwork-defined connection system counterparts 170, wherein the number of formwork-defined connection system counterparts 170 is based on the number of connection systems for connecting the first formwork 100 and the third formwork 300.

Figure 5:
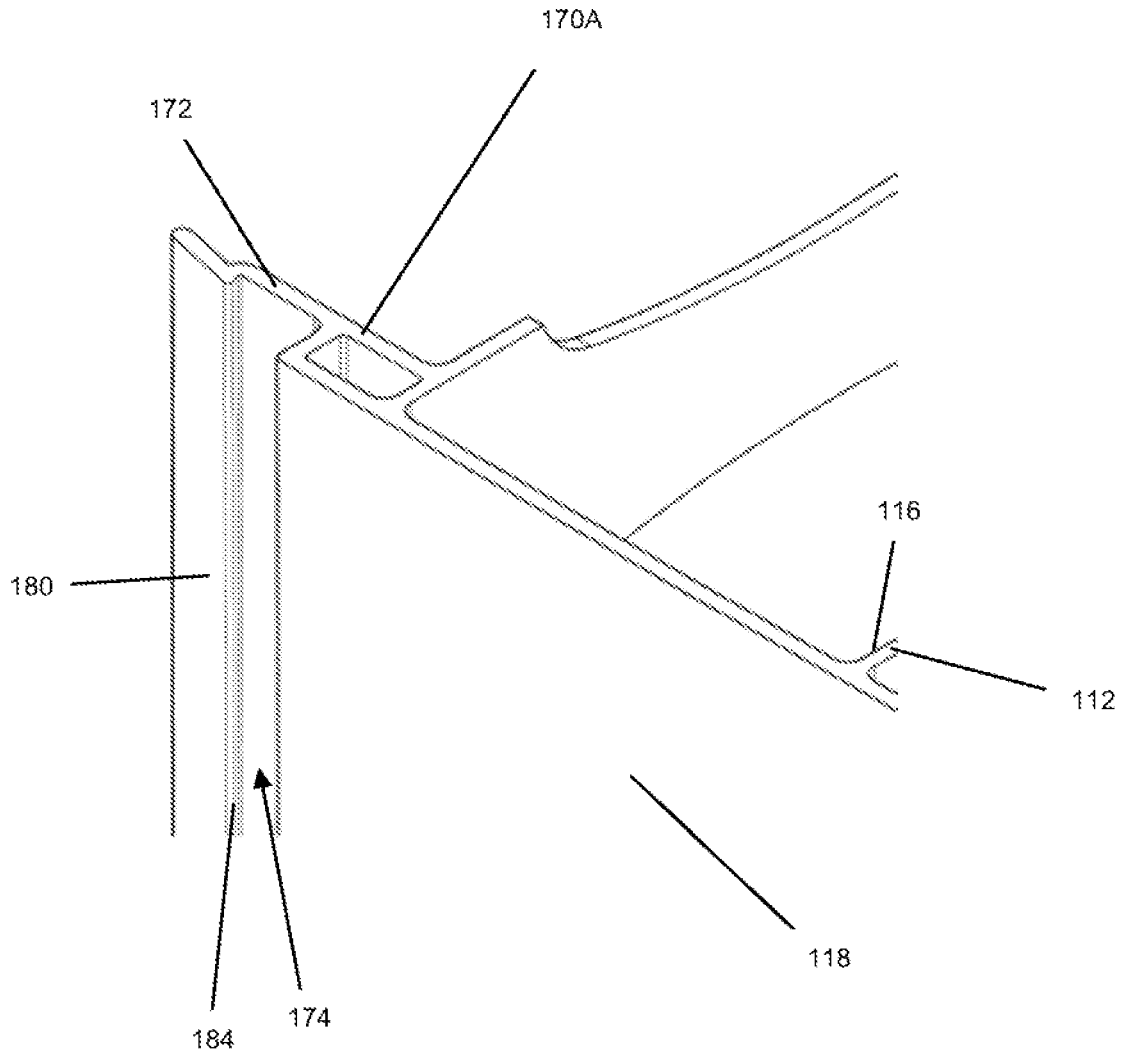
FIG. 5 is a perspective view of a formwork-defined third connection system counterpart of the formwork of FIG. 1.

FIG. 5 is a perspective view of a formwork-defined third connection system counterpart 170A.

The formwork-defined third connection system counterpart 170A extends from the slurry-receiving structure 103. In some embodiments, for example, the formwork-defined third connection system counterpart 170A extends from an outermost surface of the formwork 100. In some embodiments, for example, the outermost surface of the formwork 100 is defined by an outer surface of an end wall or a side wall. As depicted in FIG. 1, FIG. 2, and FIG. 5, in some embodiments, for example, the outermost surface from which the formwork-defined third connection system counterpart 170A extends is the outer surface 116 of the second end wall 112.

In some embodiments, for example, the formwork-defined third connection system counterpart 170A includes an interlocking portion 180 for effecting interlocking engagement with a third connection system counterpart 350A of the another formwork, for example, a third formwork 300. As depicted in FIG. 5, the interlocking portion 180 of the formwork defined third connection system counterpart 170A is connected to a substrate portion 172, and is offset from the outer surface 116.

Figure 10:
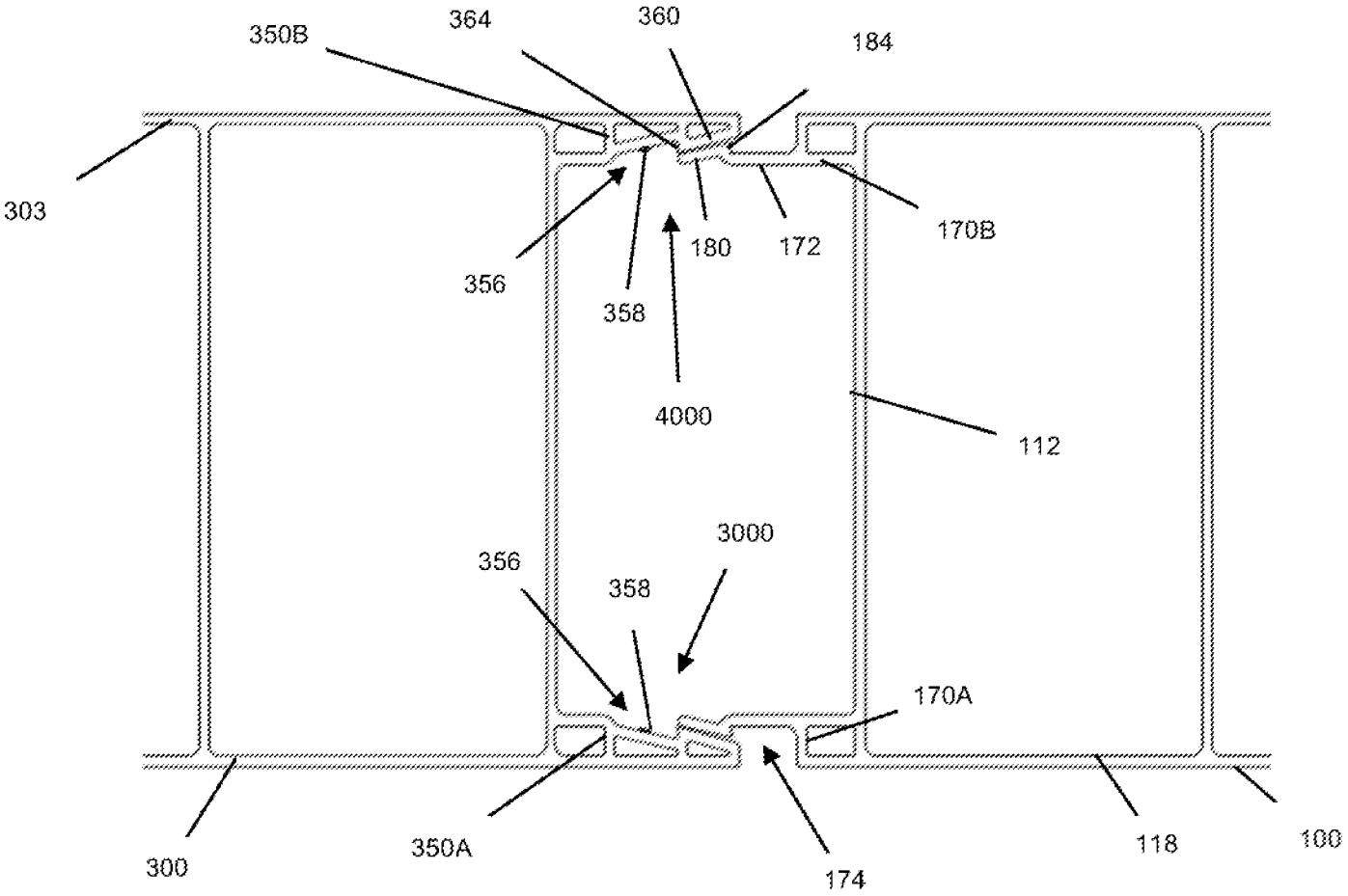
FIG. 10 is a top view of the first formwork connected to a third formwork.

As depicted in FIG. 5, the interlocking portion 180 includes a substrate portion 172, which defines a recess 174 for receiving an interlocking portion 360 of a connection system counterpart 350, for example, third connection system counterpart 350A of a third formwork 300, as depicted in FIG. 10, as described in greater detail herein.

In some embodiments, for example, the extension of the formwork-defined third connection system counterpart 170A, such as the interlocking portion 180, from the slurry-receiving structure 103, is defined by the extension of the substrate portion 172 from the slurry-receiving structure 103.

As depicted in FIG. 5, one end of the substrate portion 172 is connected to the outer surface 116 of the second end wall 112. In some embodiments, for example, the substrate portion 172 is disposed in alignment with the first side wall 118. As depicted, in some embodiments, for example, the substrate portion 172 is disposed inwardly towards the longitudinal axis 101 on the outer surface 116 relative to the first side wall 118, such that the substrate portion 172 and the first side wall 118 are not disposed in alignment.

In some embodiments, for example, as depicted in FIG. 5, the substrate portion 172 extends perpendicularly from the outer surface 116. In some embodiments, for example, a normal axis defined by a wall surface of the substrate portion 172 is perpendicular to the normal axis 138 defined by the outer surface 116 of the second end wall 112.

The interlocking portion 180 includes an abutment surface 184. In some embodiments, for example, as depicted in FIG. 5, the abutment surface 184 extends from the substrate portion 172. As described in greater detail herein, the abutment surface 184 of the interlocking portion 180 of the formwork-defined third connection system counterpart 170A functions to resist separation of the first formwork 100 and the third formwork 300 after the first formwork 100 and the third formwork 300 are connected.

In some embodiments, for example, the formwork-defined third connection system counterpart 170A is resilient, or includes one or more resilient portions, such that it is moveable between: (i) a first position for facilitating engagement of the formwork-defined third connection system counterpart 170A and the third connection system counterpart 350A such that one of the first formwork 100 and the third formwork 300 are displaceable towards the other of the first formwork 100 and the third formwork 300 while the formwork-defined third connection system counterpart 170A and the third connection system counterpart 350A are engaged, and (ii) a second position for retention of the formwork-defined third connection system counterpart 170A and the third connection system counterpart 350A.

Figure 6:
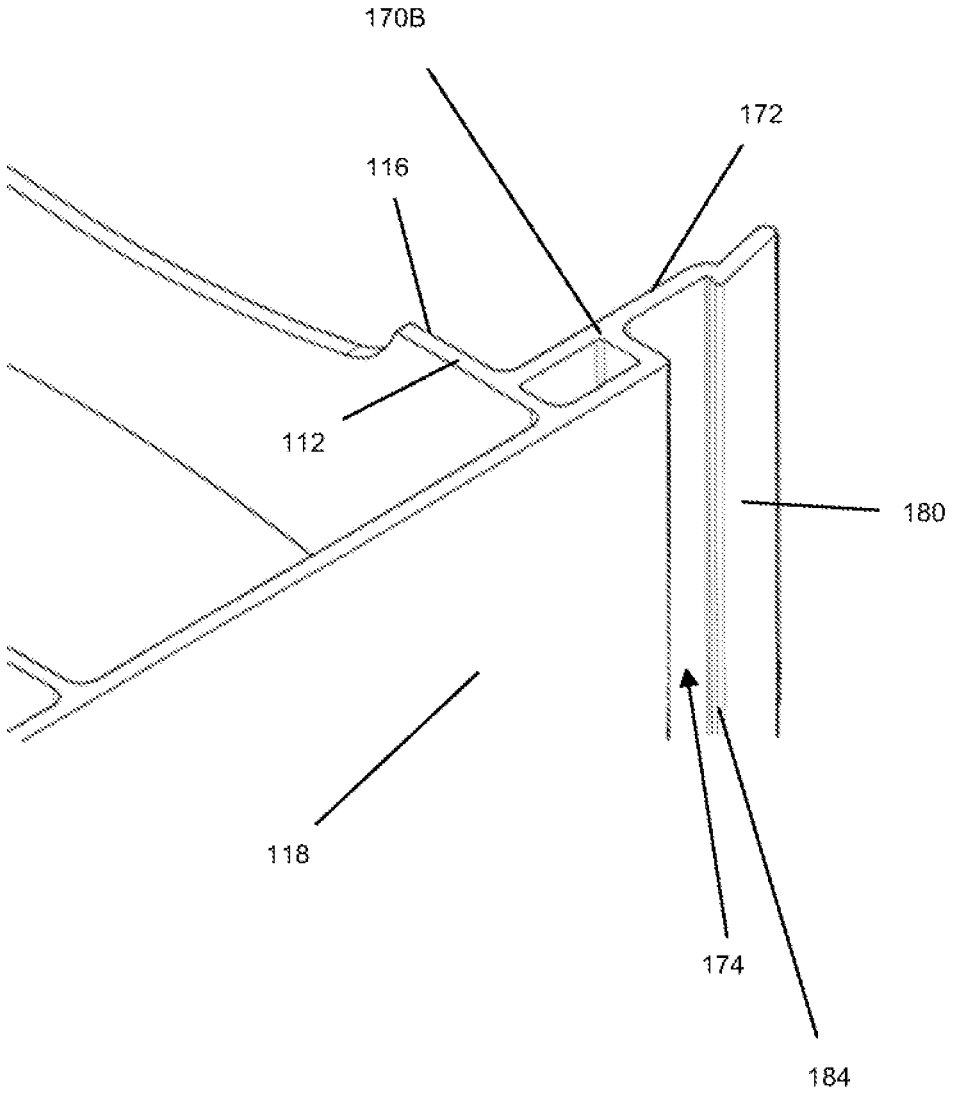
FIG. 6 is a perspective view of a formwork-defined fourth connection system counterpart of the formwork of FIG. 1.

FIG. 6 is a perspective view of a formwork-defined fourth connection system counterpart 170B.

The formwork-defined fourth connection system counterpart 170B extends from the slurry-receiving structure 103. In some embodiments, for example, the formwork-defined fourth connection system counterpart 170B extends from an outermost surface of the formwork 100. In some embodiments, for example, the outermost surface of the formwork 100 is defined by an outer surface of an end wall or a side wall. As depicted in FIG. 1, FIG. 2, and FIG. 6, in some embodiments, for example, the outermost surface from which the formwork-defined fourth connection system counterpart 170B extends is the outer surface 116 of the second end wall 112.

As depicted in FIG. 1 and FIG. 2, the formwork-defined first connection system counterpart 150A and the formwork-defined second connection system counterpart 150A extend from a first wall of the formwork 400, such as the first end wall 106, and the formwork-defined third connection system counterpart 170A and the formwork-defined fourth connection system counterpart 170B extend from a second wall of the formwork 400 that is disposed opposite the first wall of the formwork 400, for example, the second end wall 112.

In some embodiments, for example, the formwork-defined fourth connection system counterpart 170B includes an interlocking portion 180 for effecting interlocking engagement with a fourth connection system counterpart 350B of the another formwork, for example, a third formwork 300. As depicted in FIG. 6, the interlocking portion 180 of the formwork-defined fourth connection system counterpart 170B is connected to a substrate portion 172, and is offset from the outer surface 116.

As depicted in FIG. 6, the interlocking portion 180 includes a substrate portion 172, which defines a recess 174 for receiving an interlocking portion 360 of a connection system counterpart 350, for example, fourth connection system counterpart 350B of a third formwork 300, as depicted in FIG. 10, as described in greater detail herein.

In some embodiments, for example, the extension of the formwork-defined fourth connection system counterpart 170B, such as the interlocking portion 180, from the slurry-receiving structure 103, is defined by the extension of the substrate portion 172 from the slurry-receiving structure 103. As depicted in FIG. 1 and FIG. 2, the substrate portions 172 of the formwork-defined third connection system counterpart 170A and the formwork-defined fourth connection system counterpart 170B are disposed opposite to each other.

As depicted in FIG. 6, one end of the substrate portion 172 is connected to the outer surface 116 of the second end wall 112. In some embodiments, for example, the substrate portion 172 is disposed in alignment with the first side wall 118. As depicted, in some embodiments, for example, the substrate portion 172 is disposed inwardly towards the longitudinal axis 101 on the outer surface 116 relative to the first side wall 118, such that the substrate portion 172 and the first side wall 118 are not disposed in alignment.

In some embodiments, for example, as depicted in FIG. 6, the substrate portion 172 extends perpendicularly from the outer surface 116. In some embodiments, for example, a normal axis defined by a wall surface of the substrate portion 172 is perpendicular to the normal axis 138 defined by the outer surface 116 of the second end wall 112.

The interlocking portion 180 includes an abutment surface 184. In some embodiments, for example, as depicted in FIG. 6, the abutment surface 184 extends from the substrate portion 172. As described in greater detail herein, the abutment surface 184 of the interlocking portion 180 of the formwork-defined fourth connection system counterpart 170B functions to resist separation of the first formwork 100 and the third formwork 300 after the first formwork 100 and the third formwork 300 are connected.

In some embodiments, for example, the formwork-defined fourth connection system counterpart 170B is resilient, or includes one or more resilient portions, such that it is moveable between: (i) a first position for facilitating engagement of the formwork-defined fourth connection system counterpart 170B and the fourth connection system counterpart 350B such that one of the first formwork 100 and the third formwork 300 are displaceable towards the other of the first formwork 100 and the third formwork 300 while the formwork-defined fourth connection system counterpart 170B and the fourth connection system counterpart 350B are engaged, and (ii) a second position for retention of the formwork-defined fourth connection system counterpart 170B and the fourth connection system counterpart 350B.

In some embodiments, for example, the formwork-defined third connection system counterpart 170A, the formwork-defined fourth connection system counterpart 170B, and the end wall from which they extend, such as the second end wall 112, are co-operatively configured such that, while the first formwork 100 and the third formwork 300 are co-operatively disposed for connection, the formwork-defined third connection system counterpart 170A and the formwork-defined fourth connection system counterpart 170B of the first formwork 100 extends from the end wall 112 such that the formwork-defined third connection system counterpart 170A and the formwork-defined fourth connection system counterpart 170B, for example, the interlocking portions 180, are aligned with the corresponding third connection system counterpart 350A and fourth connection system counterpart 350B of the third formwork 300, for example, the interlocking portions 360, such that the formwork-defined first connection system counterpart 170A and the formwork-defined fourth connection system counterpart 170B, for example, the interlocking portions 180, of the first formwork 100 are engageable with the corresponding third connection system counterpart 350A and the fourth connection system counterpart 350B, for example, the interlocking portions 360, of the third formwork 300.

In some embodiments, for example, the formwork-defined third connection system counterpart 170A and the formwork-defined fourth connection system counterpart 170B extend from a wall of the formwork 100, such as the second end wall 112, such that, while the first formwork 100 and the third formwork 300 are co-operatively disposed for connection, the formwork-defined third connection system counterpart 170A and the formwork-defined fourth connection system counterpart 170B, for example, the interlocking portions 180, are aligned with the corresponding third connection system counterpart 350A and fourth connection system counterpart 350B of the third formwork 300, for example, the interlocking portions 360, such that the formwork-defined third connection system counterpart 170A and the formwork-defined fourth connection system counterpart 170B, for example, the interlocking portions 180, of the first formwork 100 are engageable with the corresponding third connection system counterpart 350A and fourth connection system counterpart 350B, for example, the interlocking portions 360, of the third formwork 300.

In some embodiments, for example, the formwork-defined third connection system counterpart 170A and the formwork-defined fourth connection system counterpart 170B extend generally perpendicularly from the second end wall 112.

In some embodiments, for example, the formwork-defined first connect system counterpart 150A and the formwork-defined second connect system counterpart 150B are disposed on an end wall of the formwork 100, for example, the first end wall 106, and the formwork-defined third connection system counterpart 170A and the formwork-defined fourth connection system counterpart 170B from an end wall disposed opposite the end wall from which the formwork-defined first connect system counterpart 150A and the formwork-defined second connect system counterpart 150B extend, for example, the second end wall 112, as depicted in FIG. 1.

In some embodiments, for example, the formwork-defined first connect system counterpart 150A and the formwork-defined second connect system counterpart 150B are disposed on an end wall of the formwork 100, for example, the first end wall 106 or the second end wall 112, and the formwork-defined third connection system counterpart 170A and the formwork-defined fourth connection system counterpart 170B from a wall disposed adjacent the end wall from which the formwork-defined first connect system counterpart 150A and the formwork-defined second connect system counterpart 150B extend, for example, the first side wall 118 or the second side wall 124.

In some embodiments, for example, the formwork-defined first connect system counterpart 150A and the formwork-defined second connect system counterpart 150B are disposed on a side wall of the formwork 100, for example, the first side wall 118 or the second side wall 124, and the formwork-defined third connection system counterpart 170A and the formwork-defined fourth connection system counterpart 170B from a wall disposed adjacent the side wall from which the formwork-defined first connect system counterpart 150A and the formwork-defined second connect system counterpart 150B extend, for example, the first end wall 106 or the second end wall 112.

Figure 7:
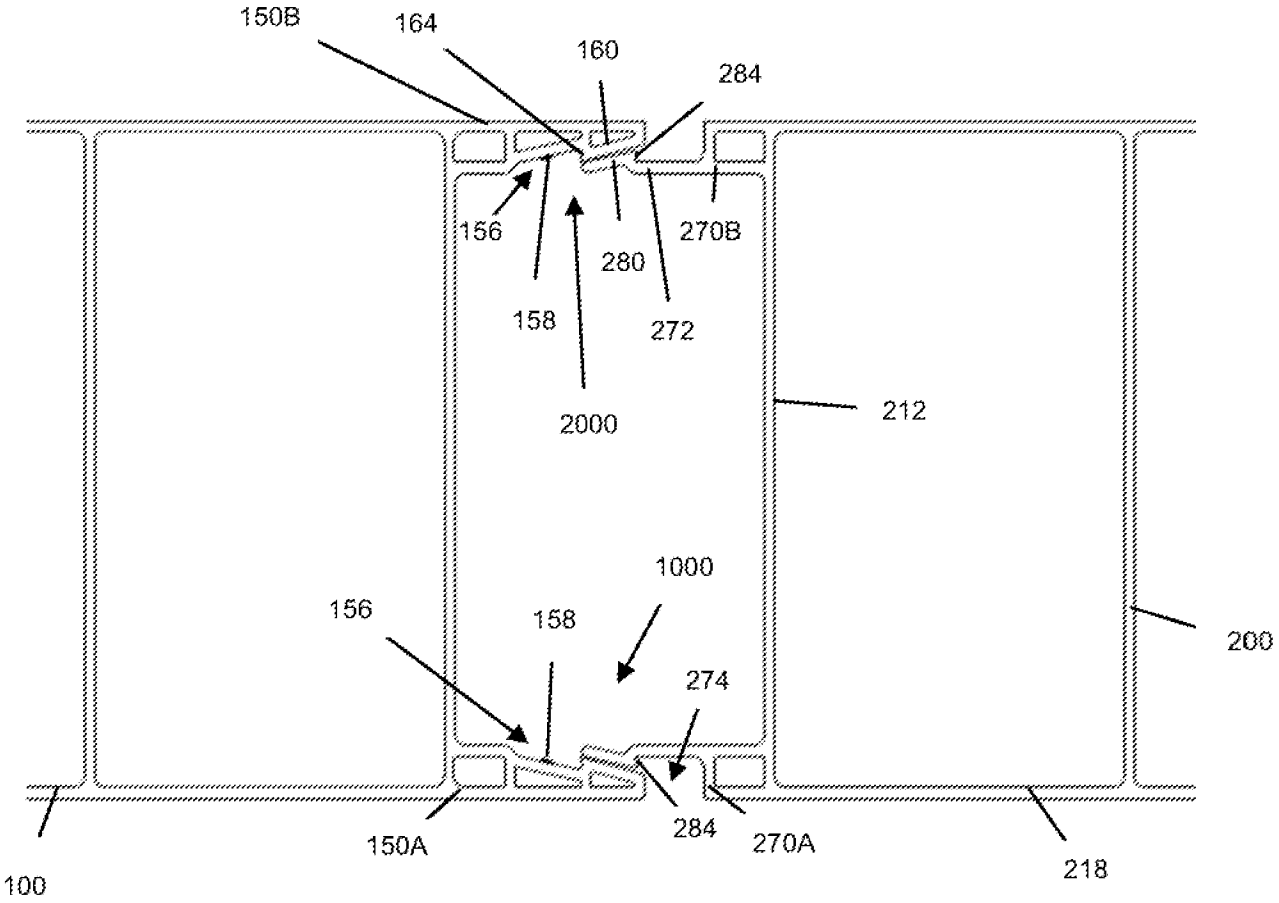
FIG. 7 is a top view of a first formwork to be connected to a second formwork.

In some embodiments, for example, as depicted in FIG. 7 and FIG. 8, a first formwork 100 is connectible with a second formwork 200 via a first connection system 1000 and a second connection system 2000, with effect that an obtained aperture 186 and an obtained internal space 188 are obtained, wherein the obtained aperture 186 and the obtained internal space 188 are co-operatively configured such that a slurry is receivable within the obtained internal space 188 via the obtained aperture 186.

In some embodiments, for example, the first connection system 1000 includes the formwork-defined first connection system counterpart 150A and the first connection system counterpart 270A of the another formwork 200.

In some embodiments, for example, the second connection system 2000 includes the formwork-defined second connection system counterpart 150B and the second connection system counterpart 270B of the another formwork 200.

In some embodiments, for example, the first connection system counterpart 270A and the second connection system counterpart 270B of the another formwork 200 have the same features as the formwork-defined third connection system counterpart 170A and the formwork-defined fourth connection system counterpart 170B. In some embodiments, for example, the first connection system counterpart 270A and the second connection system counterpart 270B of the another formwork 200 are identical to the formwork-defined third connection system counterpart 170A and the formwork-defined fourth connection system counterpart 170B.

In some embodiments, for example, the another formwork 200 includes a slurry-receiving structure 203, an aperture 202, formwork-defined internal space 204, end walls 206, 212, side walls 218, 224, a first connection system counterpart 270A, a second connection system counterpart 270B, a substrate portion 272, a recess 274, and an interlocking portion 280 having an abutment surface 284, which correspond to the slurry-receiving structure 103, the aperture 102, formwork-defined internal space 104, end walls 106, 112, side walls 118, 124, the formwork-defined third connection system counterpart 170A, the formwork-defined fourth connection system counterpart 170B the substrate portion 172, the recess 174, and the interlocking portion 180 having the abutment surface 184, respectively, as described with respect to the formwork 100.

In some embodiments, for example, the first connection system counterpart 270A and the second connection system counterpart 270B of the second formwork 200 is the formwork-defined third connection system counterpart 270A and the formwork-defined fourth connection system counterpart 270B of the second formwork 200.

In some embodiments, for example, the formwork 100 and the second formwork 200 are identical.

Figure 9:
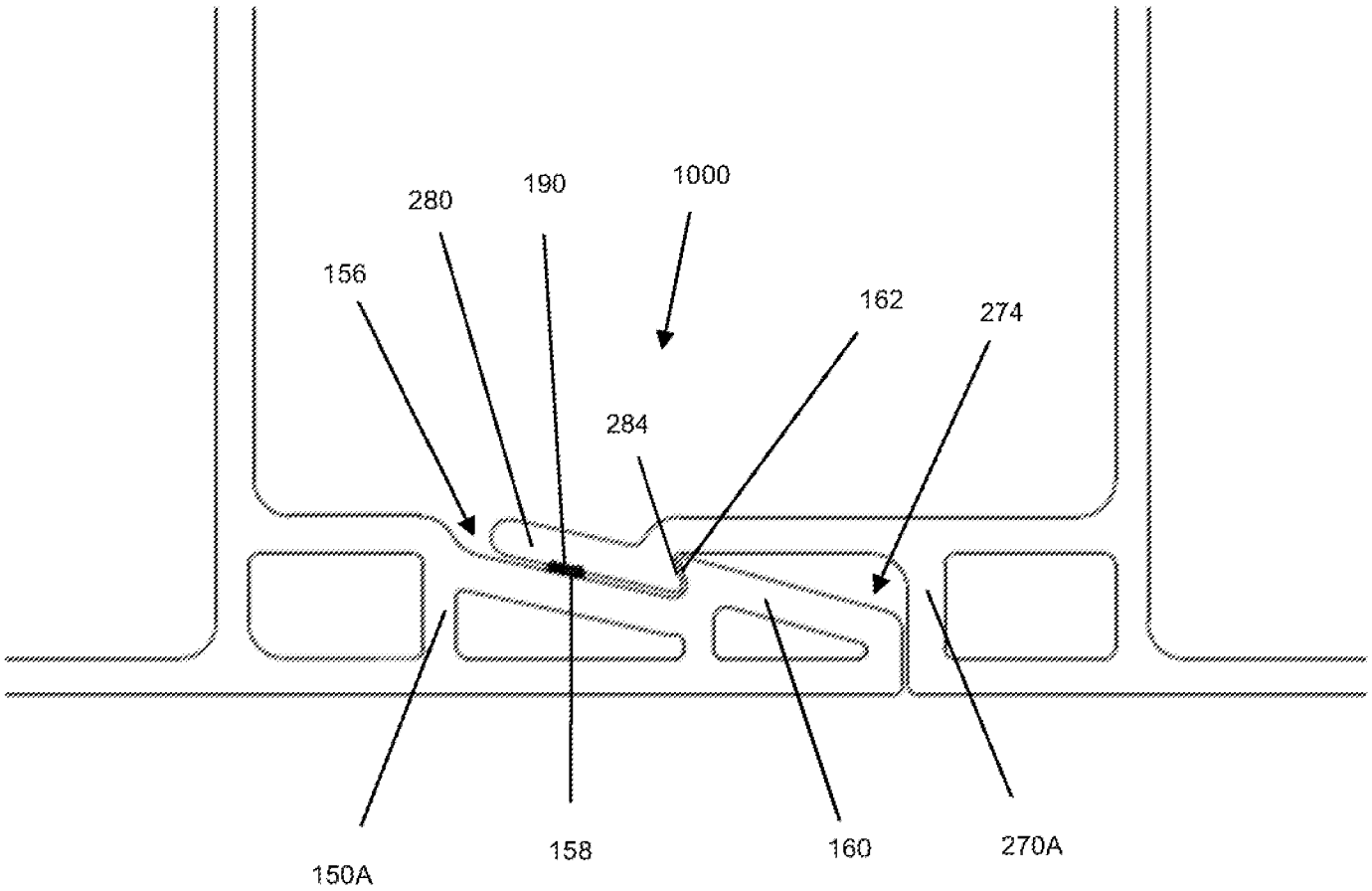
FIG. 9 is a top view of a sealed interface obtained between the formwork-defined first connection system counterpart and the first connection system counterpart of the second formwork.

In some embodiments, for example, as depicted in FIG. 7, FIG. 8, and FIG. 9, the formwork-defined first connection system counterpart 150A is configured for co-operating with the first connection system counterpart 270A of the another formwork 200 such that: (i) the connection to the another formwork 200 via the first connection system 1000 includes interlocking engagement between the formwork-defined first connection system counterpart 150A and the first connection system counterpart 270A of the another formwork 200, and (ii) the interlocking engagement is with effect that a sealing engagement is effected between the sealed interface-effecting portion 158 of the formwork-defined first connection system counterpart 150A and the first connection system counterpart 270A of the another formwork 200 such that a sealed interface 190 is obtained between the formwork-defined first connection system counterpart 150A and the first connection system counterpart 270A of the another formwork 200.

In some embodiments for example, the formwork-defined second connection system counterpart 150B is configured for co-operating with a second connection system counterpart 270B of the another formwork 200 such that: (i) the connection to the another formwork 200 via the second connection system 2000 includes interlocking engagement between the formwork-defined second connection system counterpart 150B and the second connection system counterpart 270B of the another formwork 200, and (ii) the interlocking engagement is with effect that a sealing engagement is effected between the sealed interface-effecting portion 158 of the formwork-defined second connection system counterpart 150B and the second connection system counterpart 270B of the another formwork 200 such that a sealed interface 190 is obtained between the formwork-defined second connection system counterpart 150B and the second connection system counterpart 270B of the another formwork 200.

In some embodiments, for example, the first formwork 100 and the second formwork 200 are connectible via snap-fit engagement. In some embodiments, for example, the interlocking engagement between the formwork-defined first connection system counterpart 150A and the first connection system counterpart 270A of the another formwork 200 is effected via snap fit engagement, and the interlocking engagement between the formwork-defined second connection system counterpart 150B and the second connection system counterpart 270B of the another formwork 200 is effected via snap-fit engagement.

The first formwork 100 and the second formwork 200 are disposed for connection, as depicted in FIG. 7, and one of the first formwork 100 and the second formwork 200 is displaced towards the other of the first formwork 100 and the second formwork 200 in order for: 1) the interlocking portions 160 of the formwork-defined first connection system counterpart 150A and the formwork-defined second connection system counterpart 150B to be aligned with the recesses 274 of the first connection system counterpart 270A and second connection system counterpart 270B of the second formwork, and 2) the interlocking portions 280 of the first connection system counterpart 270A and second connection system counterpart 270B of the second counterpart 200 to be aligned with the recesses 156 of the formwork-defined first connection system counterpart 150A and the formwork-defined second connection system counterpart 150B. In some embodiments, for example, the first formwork 100 and the second formwork 200 are displaced towards each other.

In response to alignment of the interlocking portions 160 of the formwork-defined first connection system counterpart 150A and the formwork-defined second connection system counterpart 150B with the recesses 274 of the first connection system counterpart 270A and second connection system counterpart 270B of the second formwork, the interlocking portions 160 of the formwork-defined first connection system counterpart 150A and the formwork-defined second connection system counterpart 150B are received in, for example, snapped into, the recesses 274 of the first connection system counterpart 270A and second connection system counterpart 270B.

In response to alignment of the interlocking portions 280 of the first connection system counterpart 270A and second connection system counterpart 270B of the second counterpart 200 with the recesses 156 of the formwork-defined first connection system counterpart 150A and the formwork-defined second connection system counterpart 150B, the interlocking portions 280 of the first connection system counterpart 270A and second connection system counterpart 270B of the second counterpart 200 are received in, for example, snapped into, the recesses 156 of the formwork-defined first connection system counterpart 150A and the formwork-defined second connection system counterpart 150B.

In some embodiments, for example, the interlocking engagement between the formwork-defined first connection system counterpart 150A and the first connection system counterpart 270A of the another formwork 200 is effected via deflection of at least one of the formwork-defined first connection system counterpart 150A and the first connection system counterpart of the another formwork 270A, and the interlocking engagement between the formwork-defined second connection system counterpart 150B and the second connection system counterpart 270B of the another formwork 200 is effected via deflection of at least one of the formwork-defined second connection system counterpart 150B and the second connection system counterpart 270B of the another formwork 200.

While the first formwork 100 and the second formwork 200 are relatively displaced towards each other for connecting the first formwork 100 and the second formwork 200, at least one of, or both of: 1) the formwork-defined first connection system counterpart 150A and the formwork-defined second connection system counterpart 150B, and 2) the first connection system counterpart 270A and the second connection system counterpart 270B of the second formwork 200, are resiliently displaced between the first position and the second Position to allow for: 1) the interlocking portions 160 of the formwork-defined first connection system counterpart 150A and the formwork-defined second connection system counterpart 150B to snap into the recesses 274 of the first connection system counterpart 270A and second connection system counterpart 270B, and 2) the interlocking portions 280 of the first connection system counterpart 270A and second connection system counterpart 270B of the second counterpart 200 to snap into in the recesses 156 of the formwork-defined first connection system counterpart 150A and the formwork-defined second connection system counterpart 150B.

With respect to the formwork-defined first connection system counterpart 150A and the formwork-defined second connection system counterpart 150B, the resilient displacement to the first position includes outward and inward displacement, for example, radially outward and inward displacement, relative to the longitudinal axis 101.

With respect to the first connection system counterpart 270A and the second connection system counterpart 270B of the second formwork 200, the resilient displacement to the first position includes outward and inward displacement, for example, radially inward displacement, relative to the longitudinal axis 101.

At this point, as depicted in FIG. 8 and FIG. 9, the interlocking portions 160 of the formwork-defined first connection system counterpart 150A and the formwork-defined second connection system counterpart 150B are received in the recesses 274 of the first connection system counterpart 270A and second connection system counterpart 270B of the second formwork 200, and the interlocking portions 280 of the first connection system counterpart 270A and second connection system counterpart 270B of the second counterpart 200 are received in the recesses 156 of the formwork-defined first connection system counterpart 150A and the formwork-defined second connection system counterpart 150B, such that the first formwork 100 and the second formwork 200 are connected, for example, via an interlocking engagement between: 1) the formwork-defined first connection system counterpart 150A and the first connection system counterpart 270A of the another formwork 200, and 2) the formwork-defined second connection system counterpart 150B and the second connection system counterpart of the another formwork 270B.

In some embodiments, for example, as depicted in FIG. 9, while the first formwork 100 and the second formwork 200 are connected, the abutment surfaces 162 of the formwork-defined first connection system counterpart 150A and the formwork-defined second connection system counterpart 150B are disposed opposite the abutment surfaces 284 of the first connection system counterpart 270A and second connection system counterpart 270B. In this regard, the abutment surfaces 162 and the abutment surfaces 284 are cooperatively configured to resist separation of the first formwork 100 and the second formwork 200 after the first formwork 100 and the second formwork 200 are connected. After the first formwork 100 and the second formwork 200 are connected, in response to application of force to the first formwork 100 and/or to the second formwork 200 to separate the first formwork 100 and the second formwork 200, the abutment surfaces 162 and the abutment surfaces 284 become disposed in abutting engagement with each other, such that separation of the first formwork 100 and the second formwork 200 is resisted.

As depicted in FIG. 8 and FIG. 9, the interlocking engagement between the formwork-defined first connection system counterpart 150A and the first connection system counterpart 270A of the another formwork 200 is with effect that a sealing engagement is effected between the sealed interface-effecting portion 158 of the formwork-defined first connection system counterpart 150A and the first connection system counterpart 270A of the another formwork 200 such that a sealed interface 190 is obtained between the formwork-defined first connection system counterpart 150A and the first connection system counterpart 270A of the another formwork 200, and the interlocking engagement between the formwork-defined second connection system counterpart 150B and the second connection system counterpart 270B of the another formwork 200 is with effect that a sealing engagement is effected between the sealed interface-effecting portion 158 of the formwork-defined second connection system counterpart 150B and the second connection system counterpart 270B of the another formwork 200 such that a sealed interface 190 is obtained between the formwork-defined second connection system counterpart 150B and the second connection system counterpart 270B of the another formwork 200.

In some embodiments, for example, the sealed interface 190 obtained between the formwork-defined first connection system counterpart 150A and the first connection system counterpart 270A of the another formwork 200 is effected via deformation of the sealed interface-effecting portion 158 of the formwork-defined first connection system counterpart 150A, and the sealed interface 190 obtained between the formwork-defined second connection system counterpart 150B and the second connection system counterpart 270B of the another formwork 200 is effected via deformation of the sealed interface-effecting portion 158 of the formwork-defined second connection system counterpart 150B.

In particular, as depicted in FIG. 9, while the interlocking portions 280 of the first connection system counterpart 270A and the second connection system counterpart 270B of the second formwork 200 is received in the recesses 156 of the formwork-defined first connection system counterpart 150A and the formwork-defined second connection system counterpart 150B, the interlocking portions 280 are engaged with, for example, abutting against, the sealed interface-effecting portions 158 to obtain the sealed interfaces 190. While the sealed interface-effecting portions 158 are abutting against the interlocking portions 280, at least a portion of the sealed interface-effecting portions 158 deform to obtain the sealed interfaces 190, such that the sealing engagement is defined between the formwork-defined first connection system counterpart 150A and the formwork-defined second connection system counterpart 150B and the first connection system counterpart 270A and the second connection system counterpart 270B, respectively.

With the first formwork 100 and the second formwork 200 connected, the obtained aperture 186 and the obtained internal space 188 are obtained, as depicted in FIG. 8. In some embodiments, for example, the obtained aperture 186 and the obtained internal space 188 are defined between the first formwork 100 and the second formwork 200. In some embodiments, for example, as depicted in FIG. 8, the obtained aperture 186 and the obtained internal space 188 are defined between the first end wall 106 of the first formwork 100, the second end wall 212 of the second formwork 200, the formwork-defined first connection system counterpart 150A, the formwork-defined second connection system counterpart 150B, the first connection system counterpart 270A, and the second connection system counterpart 270B. In some embodiments, for example, at least a portion of the obtained aperture 186 and the obtained internal space 188 are defined between the wall portions 152 of the formwork-defined first connection system counterpart 150A and the formwork-defined second connection system counterpart 150B. In some embodiments, for example, at least a portion of the obtained aperture 186 and the obtained internal space 188 are defined between the substrate portions 272 of the first connection system counterpart 270A and the second connection system counterpart 270B.

The obtained aperture 186 is disposed in fluid communication with the obtained internal space 188. The obtained aperture 186 and the obtained internal space 188 are cooperatively configured such that a material, such as slurry, concrete, and the like, is receivable within the obtained internal space 188 via the obtained aperture 186. In some embodiments, for example, the obtained internal space 188 is a channel that extends through the body of the connected first formwork 100 and second formwork 200, such that a first obtained aperture 186 is defined on a first side of the connected formworks, for example, a top side, and a second obtained aperture 186 is defined on a second side of the connected formworks, for example, a bottom side, with the obtained internal space 188 fluidly communicating the first and second obtained apertures 186, as depicted in FIG. 8.

In some embodiments, for example, the obtained internal space 188 is configured to contain the received slurry while the connected formworks are supported on a planar base. In such embodiments, for example, while the formwork 100 is supported on the planar base, the planar base prevents flow of slurry out of the bottom obtained aperture 186, such that slurry that is received within the obtained internal space 188 is contained in the obtained internal space 188.

In some embodiments, for example, the obtained internal space 188 has a minimum volume of at least 0.005 $m^3$, for example, 0.05 $m^3$, for example, 0.1 $m^3$, for example, 0.2 $m^3$, for example, 0.3 $m^3$, for example, 0.4 $m^3$, for example, 0.5 $m^3$.

In some embodiments, for example, slurry that is received in and contained in the obtained internal space 188 applies an outward force on the surfaces that define the obtained internal space 188, for example, the outer surface 110 of the first end wall 106 of the first formwork 100, the outer surface 216 of the second end wall 212 of the second formwork 200, the formwork-defined first connection system counterpart 150A and the formwork-defined second connection system counterpart 150B of the first formwork 100, in particular, the interlocking portions 160 and the wall portions 152, the first connection system counterpart 270A and the second connection system counterpart 270B of the second formwork 200, in particular, the substrate portions 272 and the interlocking portions 280.

In some embodiments, for example, the force applied by the slurry contained in the obtained internal space 188 to the outer surface 110 of the first end wall 106 of the first formwork 100 the outer surface 216 of the second end wall 212 of the second formwork 200 urges separation of the first formwork 100 and the second formwork 200. In some embodiment, for example, the abutment surfaces 162 and the abutment surfaces 284, which are disposed in opposition while the first formwork 100 and the second formwork 200 are connected, are co-operatively configured to resist separation of the first formwork 100 and the second formwork 200 due to the force applied by the slurry contained in the obtained internal space 188 to the outer surface 110 of the first end wall 106 of the first formwork 100 and the outer surface 216 of the second end wall 212 of the second formwork 200.

In some embodiments, for example, the force applied by the slurry contained in the obtained internal space 188 to the substrate portions 272 or to the interlocking portions 280 of the first connection system counterpart 270A and the second connection system counterpart 270B of the second formwork 200 effects, or further effects, the sealing engagement between: 1) the sealed interface-effecting portion 158 of the formwork-defined first connection system counterpart 150A and the first connection system counterpart 270A, and 2) the sealed interface-effecting portion 158 of the formwork-defined second connection system counterpart 150B and the second connection system counterpart 270B, such that the sealed interfaces 190 are obtained, or further obtained, between: 1) the formwork-defined first connection system counterpart 150A and the first connection system counterpart 270A, and 2) the formwork-defined second connection system counterpart 150B and the second connection system counterpart 270B.

In some embodiments, for example, the sealed interface 190 obtained between the formwork-defined first connection system counterpart 150A and the first connection system counterpart 270A of the another formwork 200, and the sealed interface 190 obtained between the formwork-defined second connection system counterpart 150B and the second connection system counterpart 270B of the another formwork 200, are co-operatively configured to resist flow of material or leakage of material received in the obtained internal space 188 between: 1) the formwork-defined first connection system counterpart 150A and the first connection system counterpart 270A of the another formwork 200, and 2) the formwork-defined second connection system counterpart 150B and the second connection system counterpart 270B of the another formwork 200.

Figure 11:
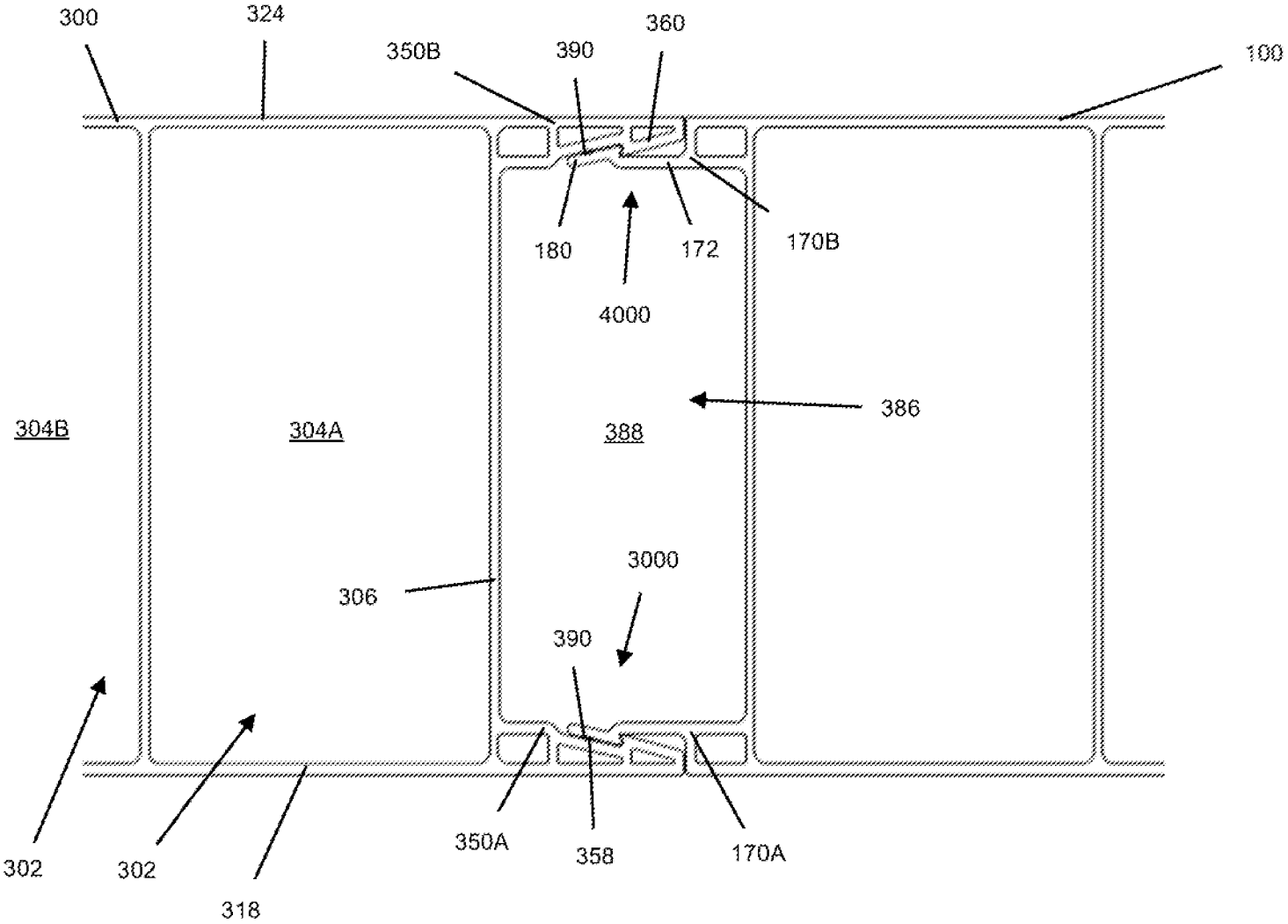
FIG. 11 is a top view of the first formwork connected to the third formwork of FIG. 10.

In some embodiments, for example, as depicted in FIG. 10 and FIG. 11, a first formwork 100 is connectible with a third formwork 300 via a third connection system 3000 and a fourth connection system 4000, with effect that an obtained aperture 386 and an obtained internal space 388 are obtained, wherein the obtained aperture 386 and the obtained internal space 388 are co-operatively configured such that a slurry is receivable within the obtained internal space 388 via the obtained aperture 386.

In some embodiments, for example, the third connection system 3000 includes the formwork-defined third connection system counterpart 170A and the third connection system counterpart 350A of the third formwork 300.

In some embodiments, for example, the fourth connection system 4000 includes the formwork-defined fourth connection system counterpart 170B and the fourth connection system counterpart 350B of the third formwork 300.

In some embodiments, for example, the third connection system counterpart 350A and the fourth connection system counterpart 350B of the third formwork 300 have the same features as the formwork-defined first connection system counterpart 150A and the formwork-defined second connection system counterpart 150B of the first formwork 100. In some embodiments, for example, the third connection system counterpart 350A and the fourth connection system counterpart 350B of the third formwork 300 are identical to the formwork-defined first connection system counterpart 150A and the formwork-defined second connection system counterpart 150B of the first formwork 100.

In some embodiments, for example, the third formwork 300 include a slurry-receiving structure 303, an aperture 302, formwork-defined internal space 304, end walls 306, 312, side walls 318, 324, a third connection system counterpart 350A, a fourth connection system counterpart 350B, a wall portion 352, a substrate portion 354, a recess 356, a sealed interface-effecting portion 358, and an interlocking portion 360 having an abutment surface 364, which corresponds to the slurry-receiving structure 103, the aperture 102, formwork-defined internal space 104, end walls 106, 112, side walls 118, 124, the formwork-defined first connection system counterpart 150A, the formwork-defined second connection system counterpart 150B, the wall portion 152, substrate portion 154, the recess 156, the sealed interface-effecting portion 158, and the interlocking portion 160 having the abutment surface 164, respectively, as described with respect to the formwork 100.

In some embodiments, for example, the third connection system counterpart 350A and the fourth connection system counterpart 350B of the third formwork 300 is the formwork-defined first connection system counterpart 350A and the formwork-defined second connection system counterpart 350B of the third formwork 300.

In some embodiments, for example, the first formwork 100 and the third formwork 300 are identical.

In some embodiments, for example, the first formwork 100 and the third formwork 300 are connectible via a snap-fit engagement, in a similar manner as described with respect to the connection of the first formwork 100 and the second formwork 200. The first formwork 100 and the third formwork 300 are connected together via interlocking engagement or snap-fit engagement to obtain the sealed interfaces 390 therebetween and to obtain the obtained aperture 386 and the obtained internal space 388 in the same manner as described herein with respect to connecting the first formwork 100 and the second formwork 200 to obtain the sealed interfaces 190 and to obtain the obtained aperture 186 and the obtained internal space 188.

In some embodiments, for example, as depicted in FIG. 10 and FIG. 11, the formwork-defined third connection system counterpart 170A is configured for co-operating with the third connection system counterpart 350A of the third formwork 300, such that the connection of the first formwork 100 to the third formwork 300 via the third connection system 3000 includes interlocking engagement between the formwork-defined third connection system counterpart 170A and the third connection system counterpart 350A of the third formwork 300.

In some embodiments, for example, the formwork-defined fourth connection system counterpart 170B is configured for co-operating with the fourth connection system counterpart 350B of the third formwork 300, such that the connection of the first formwork 100 to the third formwork 300 via the fourth connection system 4000 includes interlocking engagement between the formwork-defined fourth connection system counterpart 170B and the fourth connection system counterpart 350B of the third formwork 300.

In some embodiments, for example, the interlocking engagement is with effect that a sealing engagement is effected between the formwork-defined third connection system counterpart 170A and the third connection system counterpart 350A of the third formwork 300 such that a sealed interface 390 is obtained between the formwork-defined third connection system counterpart 170A and the third connection system counterpart 350A of the third formwork 300.

In some embodiments, for example, the interlocking engagement is with effect that a sealing engagement is effected between the formwork-defined fourth connection system counterpart 170B and the fourth connection system counterpart 350B of the third formwork 300 such that a sealed interface 390 is obtained between the formwork-defined fourth connection system counterpart 170B and the fourth connection system counterpart 350B of the third formwork 300.

With the first formwork 100 and the third formwork 300 connected, the obtained aperture 386 and the obtained internal space 388 are obtained, as depicted in FIG. 11. The obtained aperture 386 and the obtained internal space 388 correspond to the obtained aperture 186 and the obtained internal space 188 obtained in response to connection of the first formwork 100 and the second formwork 200.

In some embodiments, for example, the force applied by slurry contained in the obtained internal space 388 to the substrate portions 172 or to the interlocking portions 180 of the first connection system counterpart 170A and the second connection system counterpart 170B of the first formwork 100 effects, or further effects, the sealing engagement between: 1) the sealed interface-effecting portion 358 of the third connection system counterpart 350A and the formwork-defined third connection system counterpart 170A, and 2) the sealed interface-effecting portion 358 of the fourth connection system counterpart 350B and the formwork-defined fourth connection system counterpart 170B, such that the sealed interface 390 is obtained, or further obtained, between: 1) the third connection system counterpart 350A and the formwork-defined third connection system counterpart 170A, and 2) the fourth connection system counterpart 350B and the formwork-defined fourth connection system counterpart 170B.

In some embodiments, for example, the sealed interface 390 obtained between the formwork-defined third connection system counterpart 170A and the third connection system counterpart 350A of the third formwork 300, and the sealed interface 190 obtained between the formwork-defined fourth connection system counterpart 170B and the fourth connection system counterpart 350B of the third formwork 300, are co-operatively configured to resist flow of material or leakage of material received in the obtained internal space 388 between: 1) the formwork-defined third connection system counterpart 170A and the third connection system counterpart 350A of the third formwork 300, and 2) the formwork-defined fourth connection system counterpart 170B and the fourth connection system counterpart 350B of the third formwork 300.

As described herein, the formworks 100, 200, and 300 described herein are of unitary one piece construction. In some embodiments, for example, it is desirable for the formwork to be modular, or to be obtainable via connection of one or more formwork-defining counterparts.

Figure 12:
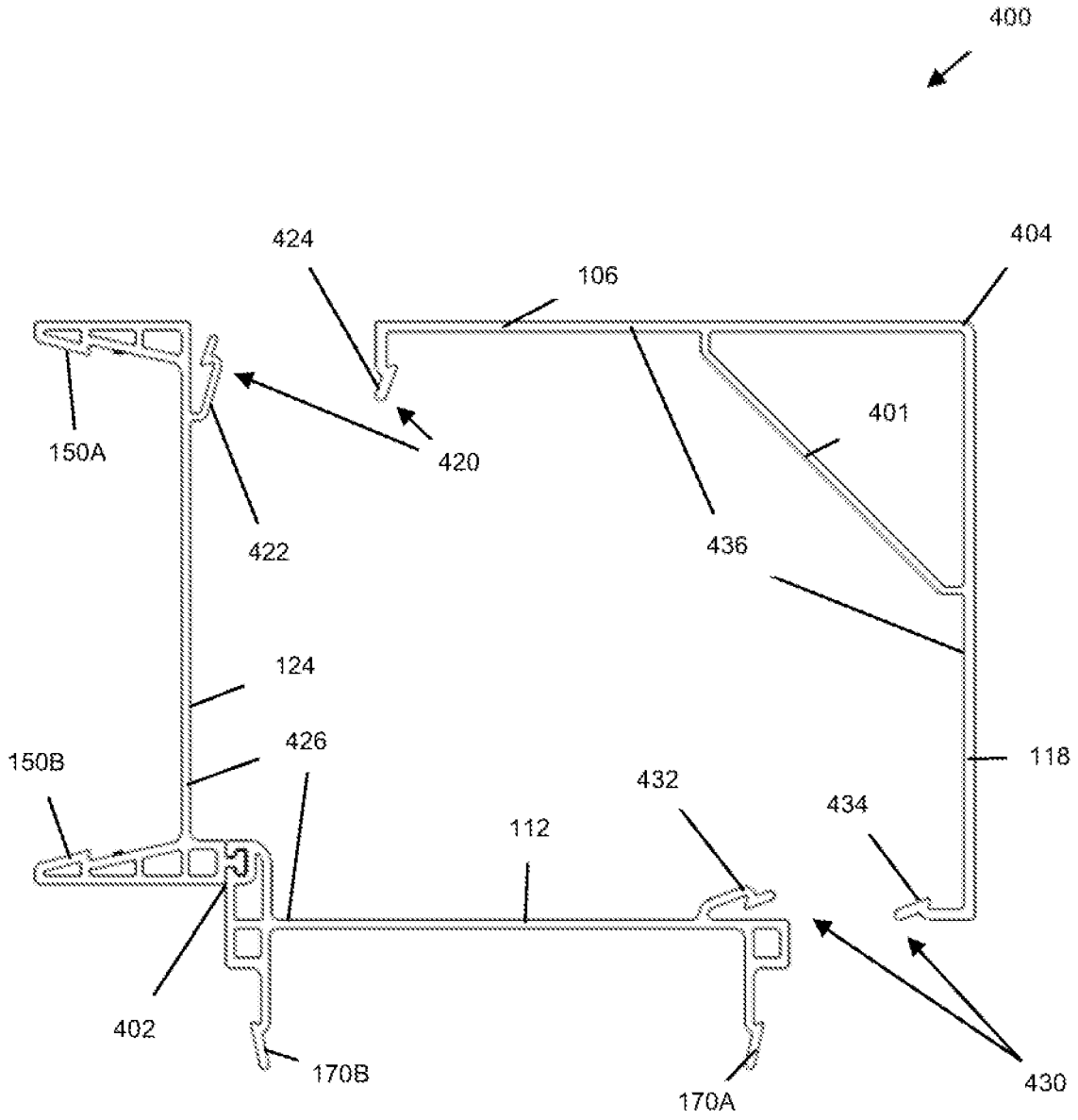
FIG. 12 is a top view of an embodiment of a modular formwork.

FIG. 12 depicts an embodiment of a formwork 400 that is modular. The formwork 400 is similar to the formworks 100, 200, and 300 as described herein, except the formwork 400 is obtainable via connection of a first formwork-defining counterpart 402 and a second formwork-defining counterpart 404. The first formwork-defining counterpart 402 and the second formwork-defining counterpart 404 are connectible to obtain the formwork 400, with effect that a slurry-receiving structure 406 is obtained, similar to the slurry-receiving structure 103 as described with respect to the formwork 100. In some embodiments, for example, the slurry-receiving structure 406 defines an aperture 408 and a formwork-defined internal space 410, which are similar to the aperture 102 and the formwork-defined internal space 104 as described with respect to the formwork 100. In some embodiments, for example, the aperture 408 and the formwork-defined internal space 410 are co-operatively configured such that a slurry is receivable within the formwork-defined internal space 410 via the aperture 408.

In some embodiments, for example, the formwork 400 has a height of at least 1 foot, for example, 2 feet, for example, 6 feet, for example, 10 feet, for example, 12 feet.

In some embodiments, for example, the formwork-defined internal space 410 has a minimum volume of at least 0.005 $m^3$, for example, 0.05 $m^3$, for example, 0.1 $m^3$, for example, 0.2 $m^3$, for example, 0.3 $m^3$, for example, 0.4 $m^3$, for example, 0.5 $m^3$.

The formwork 400 includes the formwork-defined first connection system counterpart 150A and the formwork-defined second connection system counterpart 150B for connecting and interlockingly engaging with another formwork to effect a sealing engagement therebetween, such as a second formwork 200, as described with respect to formwork 100.

Figure 13:
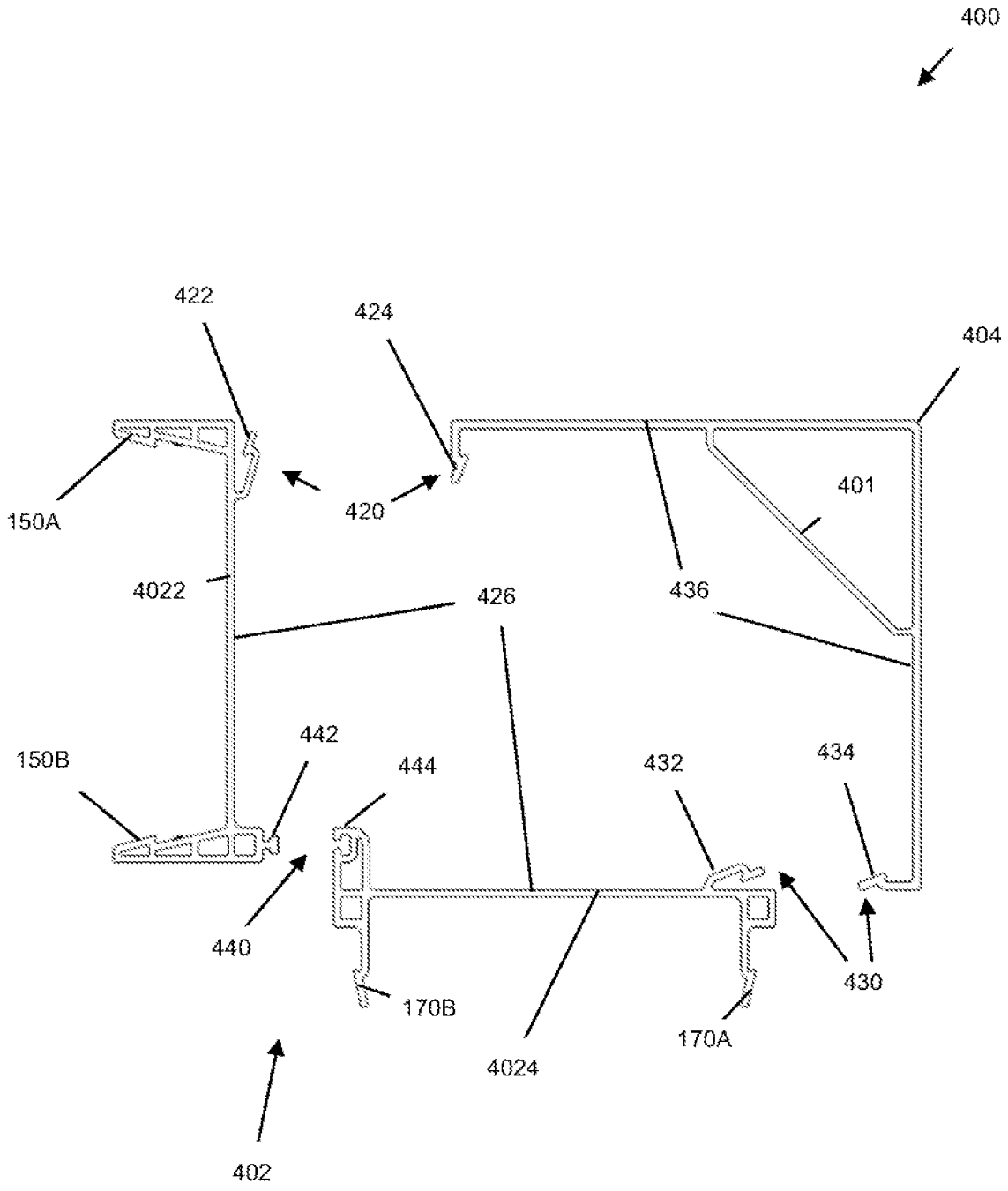
FIG. 13 is a top view of another embodiment of a modular formwork.
Figure 14:
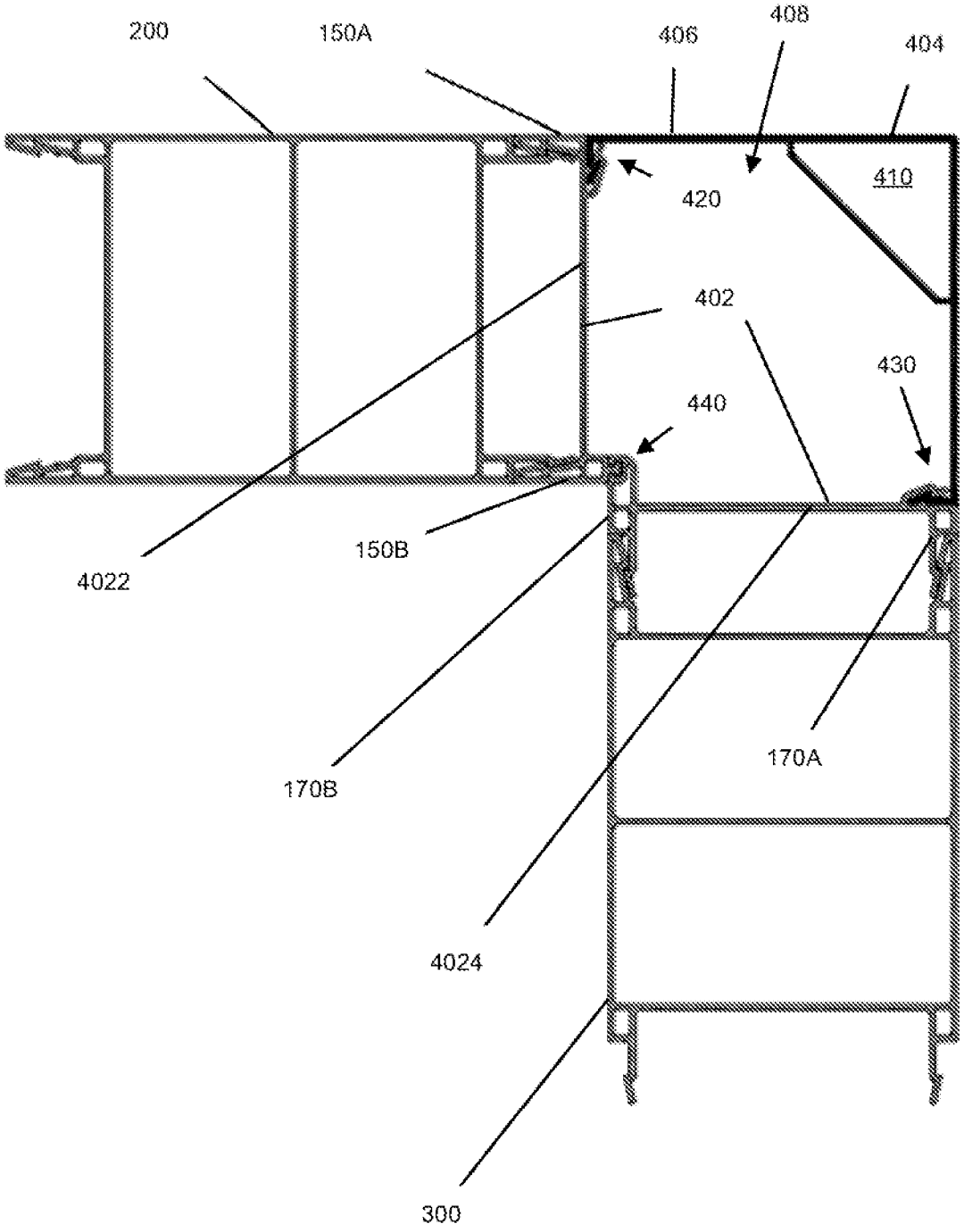
FIG. 14 is a top view of the formwork of FIG. 13 interconnecting a second formwork and a third formwork.

In some embodiments, for example, the formwork-defined first connection system counterpart 150A and the formwork-defined second connection system counterpart 150B are disposed on and extend from the first formwork-defining counterpart 402 of the formwork 400. As depicted in FIG. 12, FIG. 13, and FIG. 14, the formwork-defined first connection system counterpart 150A and the formwork-defined second connection system counterpart 150B of the formwork 400 are disposed on and extend from the second side wall 124 of the formwork 400. In some embodiments, for example, the formwork-defined first connection system counterpart 150A and the formwork-defined second connection system counterpart 150B of the formwork 400 are disposed on and extend from the second end wall 112.

In some embodiments, for example, the formwork-defined first connection system counterpart 150A and the formwork-defined second connection system counterpart 150B are disposed on and extend from the second formwork-defining counterpart 404 of the formwork 400. In some embodiments, for example, the formwork-defined first connection system counterpart 150A and the formwork-defined second connection system counterpart 150B of the formwork 400 are disposed on and extend from the first end wall 106 of the formwork 400. In some embodiments, for example, the formwork-defined first connection system counterpart 150A and the formwork-defined second connection system counterpart 150B of the formwork 400 are disposed on and extend from the first side wall 118.

In some embodiments, for example, the formwork 400 includes the formwork-defined third connection system counterpart 170A and the formwork-defined fourth connection system counterpart 170B for connecting and interlockingly engaging with another formwork to effect a sealing engagement therebetween, such as a third formwork 300, as described with respect to formwork 100.

In some embodiments, for example, the formwork-defined third connection system counterpart 170A and the formwork-defined fourth connection system counterpart 170B are disposed on and extend from the first formwork-defining counterpart 402 of the formwork 400. As depicted in FIG. 12, FIG. 13, and FIG. 14, the formwork-defined third connection system counterpart 170A and the formwork-defined fourth connection system counterpart 170B of the formwork 400 are disposed on and extend from the second end wall 112 of the formwork 400. In some embodiments, for example, the formwork-defined third connection system counterpart 170A and the formwork-defined fourth connection system counterpart 170B of the formwork 400 are disposed on and extend from the second side wall 124.

In some embodiments, for example, the formwork-defined third connection system counterpart 170A and the formwork-defined fourth connection system counterpart 170B are disposed on and extend from the second formwork-defining counterpart 404 of the formwork 400. In some embodiments, for example, the formwork-defined third connection system counterpart 170A and the formwork-defined fourth connection system counterpart 170B of the formwork 400 are disposed on and extend from the first end wall 106 of the formwork 400. In some embodiments, for example, the formwork-defined third connection system counterpart 170A and the formwork-defined fourth connection system counterpart 170B of the formwork 400 are disposed on and extend from the first side wall 118.

In some embodiments, for example, as depicted in FIG. 12, FIG. 13, and FIG. 14, the first formwork-defining counterpart 402 is connectible with the second formwork-defining counterpart 404 via one or more connection systems. As depicted, the first formwork-defining counterpart 402 is connectible with the second formwork-defining counterpart 404 via a first connection system 420 and a second connection system 430, with effect that the slurry-receiving structure 406 is obtained, wherein the slurry-receiving structure 406 defines the aperture 408 and the formwork-defined internal space 410, and the aperture 408 and the formwork-defined internal space 410 are co-operatively configured such that a slurry is receivable within the formwork-defined internal space 410 via the aperture 408.

In some embodiments, for example, the first formwork-defining counterpart 402 and the second formwork-defining counterpart 404 are connectible via snap-fit engagement, as described with respect to the connection of the first formwork 100 and the second formwork 200, or with respect to the first formwork 100 and the third formwork 300.

In some embodiments, for example, the first connection system 420 includes a first connection system counterpart 422 and a second connection system counterpart 424.

In some embodiments, for example, the connection and the interlocking engagement between the first connection system counterpart 422 and the second connection system counterpart 424 of the connection system 420 is effected via snap fit engagement, similar to: (1) the connection and the interlocking engagement between the formwork-defined first connection system counterpart 150A and the first connection system counterpart 270A of the another formwork 200, or (2) the connection and the interlocking engagement between the formwork-defined first connection system counterpart 150B and the first connection system counterpart 270B of the another formwork 200. In some embodiments, for example, at least one of the first connection system counterpart 422 and the second connection system counterpart 424 of the connection system 420 includes a sealed-interface effecting portion that is supported by a substrate portion, as described with respect to the formwork-defined first connection system counterpart 150A and the formwork-defined second connection system counterpart 150B, such that a sealing engagement is effectible between the first connection system counterpart 422 and the second connection system counterpart 424 of the connection system 420 such that a sealed interface is obtainable between the first connection system counterpart 422 and the second connection system counterpart 424 of the connection system 420.

In some embodiments, for example, the second connection system 430 includes a first connect system counterpart 432 and a second connection system counterpart 434.

In some embodiments, for example, the connection and the interlocking engagement between the first connection system counterpart 432 and the second connection system counterpart 434 of the connection system 430 is effected via snap fit engagement, similar to: (1) the connection and the interlocking engagement between the formwork-defined first connection system counterpart 150A and the first connection system counterpart 270A of the another formwork 200, or (2) the connection and the interlocking engagement between the formwork-defined first connection system counterpart 150B and the first connection system counterpart 270B of the another formwork 200. In some embodiments, for example, at least one of the first connection system counterpart 432 and the second connection system counterpart 434 of the connection system 430 includes a sealed-interface effecting portion that is supported by a substrate portion, as described with respect to the formwork-defined first connection system counterpart 150A and the formwork-defined second connection system counterpart 150B, such that a sealing engagement is effectible between the first connection system counterpart 432 and the second connection system counterpart 434 of the connection system 430 such that a sealed interface is obtainable between the first connection system counterpart 432 and the second connection system counterpart 434 of the connection system 430.

As depicted in FIG. 12 and FIG. 13, the first formwork-defining counterpart 402 includes a cavity-defining surface portion 426, and the second formwork-defining counterpart 404 includes a cavity-defining surface portion 436. The cavity-defining surface portion 426 of the first formwork-defining counterpart 402 and the cavity-defining surface portion 436 of the second formwork-defining counterpart 404 are co-operatively configured to define the slurry-receiving structure 406 while the first formwork-defining counterpart 402 and the second formwork-defining counterpart are connected 404, for example, via the connection system 420 and the connection system 430.

In some embodiments, for example, the formwork 400 includes a supporting rib 401 for providing structural strength to the formwork 400. As depicted in FIG. 12, FIG. 13, and FIG. 14, in some embodiments, for example, the second formwork-defining counterpart 404 includes the supporting rib 401, and extends from the first end wall 106 to the first side wall 118. In some embodiments, for example, while the first formwork-defining counterpart 402 and the second formwork-defining counterpart 404 are connected to define the formwork 400, the supporting rib 401 provides structural strength to the formwork 400. In some embodiments, for example, the supporting rib 401 is configured to resist change in configuration of the second formwork-defining counterpart 404, for example, configured to resist separation of the first end wall 106 and the first side wall 118.

As depicted in FIG. 13, in some embodiments, for example, the first formwork-defining counterpart 402 includes a first counterpart 4022 and a second counterpart 4024, wherein the first counterpart 4022 and the second counterpart 4024 of the first formwork-defining counterpart 402 are connectible to obtain the first formwork-defining counterpart 402, such that the cavity-defining surface portion 426 of the first formwork-defining counterpart 402 is obtained.

In some embodiments, for example, as depicted in FIG. 13 and FIG. 14, the first counterpart 4022 is connectible with the second counterpart 4024 via one or more connection systems. As depicted, the first counterpart 4022 is connectible with the second counterpart 4024 via a connection system 440, with effect that the first formwork-defining counterpart 402 is obtained.

In some embodiments, for example, the first counterpart 4022 and the second counterpart 4024 are connectible via snap-fit engagement, as described with respect to the connection of the first formwork 100 and the second formwork 200, or with respect to the first formwork 100 and the third formwork 300.

In some embodiments, for example, the connection system 440 includes a first connection system counterpart 442 and a second connection system counterpart 444.

In some embodiments, for example, the connection and the interlocking engagement between the first connection system counterpart 442 and the second connection system counterpart 444 of the connection system 440 is effected via snap fit engagement, similar to: (1) the connection and the interlocking engagement between the formwork-defined first connection system counterpart 150A and the first connection system counterpart 270A of the another formwork 200, or (2) the connection and the interlocking engagement between the formwork-defined first connection system counterpart 150B and the first connection system counterpart 270B of the another formwork 200. In some embodiments, for example, at least one of the first connection system counterpart 442 and the second connection system counterpart 444 of the connection system 440 includes a sealed-interface effecting portion that is supported by a substrate portion, as described with respect to the formwork-defined first connection system counterpart 150A and the formwork-defined second connection system counterpart 150B, such that a sealing engagement is effectible between the first connection system counterpart 442 and the second connection system counterpart 444 of the connection system 440 such that a sealed interface is obtainable between the first connection system counterpart 442 and the second connection system counterpart 444 of the connection system 420.

In some embodiments, for example, the formwork-defined first connection system counterpart 150A extends from the first counterpart 4022 of the first formwork-defining counterpart 402, and the formwork-defined second connection system counterpart 150B extends from the first counterpart 4022 of the first formwork-defining counterpart 402.

In some embodiments, for example, wherein the formwork 400 includes the formwork-defined third connection system counterpart 170A and the formwork-defined fourth connection system counterpart 170B, the formwork-defined third connection system counterpart 170A extends from the second counterpart 4024 of the first formwork-defining counterpart 402, and the formwork-defined fourth connection system counterpart 170B extends from the second counterpart 4024 of the first formwork-defining counterpart 402.

As described herein, the formwork 100 is connectible to a second formwork 200 and a third formwork 300. By connecting a plurality of formworks 100-1, 100-2, 100-3, . . . , **100-*n* together, for example, as described herein with respect to the first formwork 100, the second formwork 200, and the third formwork 300, a sequence of connected formworks 1500 is defined, as depicted in FIG. 15, the sequence of formworks extending in a direction 1502**.

In some embodiments, for example, it is desirable to change the direction of extension of the sequence of connected formworks 1500, such as while constructing a corner of a building.

Figure 15:
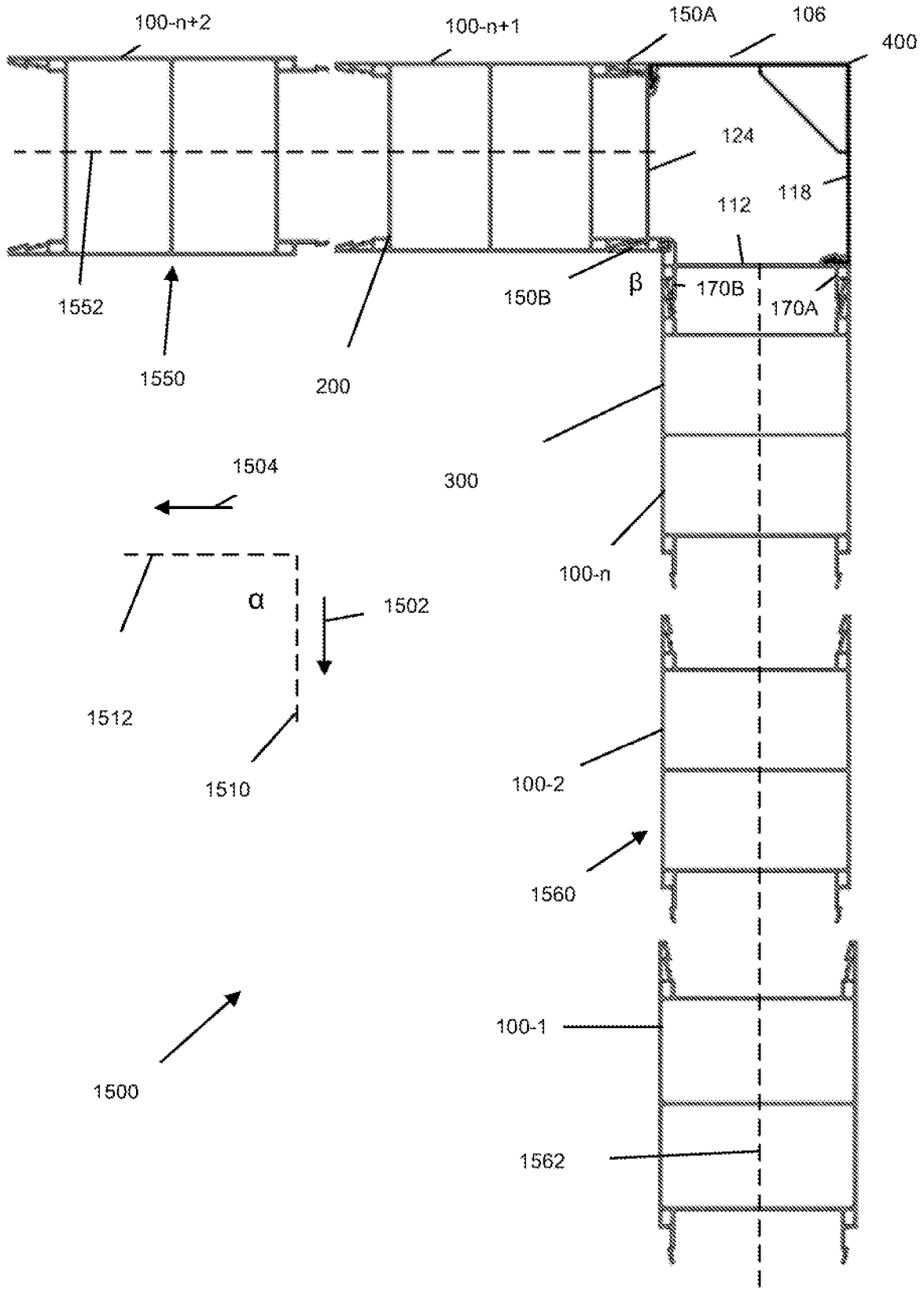
FIG. 15 is a top view of the formwork of FIG. 13 interconnecting a plurality of formworks.

FIG. 15 depicts the formwork 400 interconnecting a plurality of formworks and changing the direction of the extension of the sequence of connected formworks 1500. As depicted, additional formworks **100-*n*+1 that are connected to the formwork 400 to extend the sequence of formworks 1500 extends the sequence in a direction 1504 that is different from the direction 1502**.

In some embodiments, for example, an angle $\alpha$ defined between a first axis 1510 extending along the direction 1502 and a second axis 1512 extending along the direction 1504 is based on: 1) the relative disposition of the second end wall 112 and the second side wall 124, and 2) the relative disposition and extension of the formwork-defined first connection system counterpart 150A and the formwork-defined second connection system counterpart 150B relative to the second side wall 124. As depicted in FIG. 15, the second end wall 112 and the second side wall 124 are disposed in a perpendicular relationship, with an angle $\beta$ therebetween having a magnitude of 90°, and the formwork-defined first connection system counterpart 150A and the formwork-defined second connection system counterpart 150B extend perpendicularly outwardly from the second side 124. As depicted, the angle $\alpha$ has a magnitude of 90°. In some embodiments, for example, as the angle $\beta$ decreases in magnitude while the formwork-defined first connection system counterpart 150A and the formwork-defined second connection system counterpart 150B extend perpendicularly outwardly from the second side 124, the angle $\alpha$ decreases in magnitude. In some embodiments, for example, as the angle $\beta$ increases in magnitude while the formwork-defined first connection system counterpart 150A and the formwork-defined second connection system counterpart 150B extend perpendicularly outwardly from the second side 124, the angle $\alpha$ increases in magnitude.

In some embodiments, for example, as depicted in FIG. 14 and FIG. 15, the plastic formwork 400, the second formwork 200, and the third formwork 300 are co-operatively configured such that the plastic formwork 400 and the second formwork 200 are connectible such that at least a first wall portion 1550 is formed, the at least a first wall portion 150 defining a first central longitudinal axis 1552, the plastic formwork 400 and the third formwork 300 are connectible such that at least a second wall portion 1560 is formed, the at least a second wall portion 1560 defining a second central longitudinal axis 1562, and the first central longitudinal axis 1552 is disposed in an angled relationship, for example, a perpendicular relationship, relative to the second central longitudinal axis 1562.

In some embodiments, for example, as depicted in FIG. 14 and FIG. 15, the plastic formwork 400, the second formwork 200, and the third formwork 300 are co-operatively configured such that the second formwork 200 and the third formwork 300 are interconnectible via the plastic formwork 400, wherein, while the second formwork 200 and the third formwork 300 are interconnected via the plastic formwork 400, the second formwork 200 and the third formwork 300 are disposed in an angled relationship, for example, a perpendicular relationship.

In some embodiments, for example, as depicted in FIG. 14 and FIG. 15, the formwork 400 is a corner formwork. In some embodiments, for example, the first formwork-defining counterpart 402 defines an inner corner of the corner formwork, and the second formwork-defining counterpart 404 defines an outer corner of the corner formwork. In some embodiments, for example, the first formwork-defining counterpart 402 defines an outer corner of the corner formwork, and the second formwork-defining counterpart 404 defines an inner corner of the corner formwork.

The formwork 400, being modular and obtainable via connection of the first formwork-defining counterpart 402 and the second formwork-defining counterpart 404, allows for the slurry-receiving structure 406, such as the aperture 408 and the formwork-defined internal space 410, and building components therein, to be accessed and inspected with relative ease, prior to completion of installation of the formwork 400. In some embodiments, for example, the formwork 400 allows for a portion of, a substantial portion of, or the entirety of, the slurry-receiving structure 406, and components therein, to be exposed or accessible for additional work and inspection. In some embodiments, for example, the slurry-receiving structure 406 is exposed or accessible while the second-formwork-defining counterpart 404 is disconnected to the first formwork-defining counterpart 402.

Figure 16:
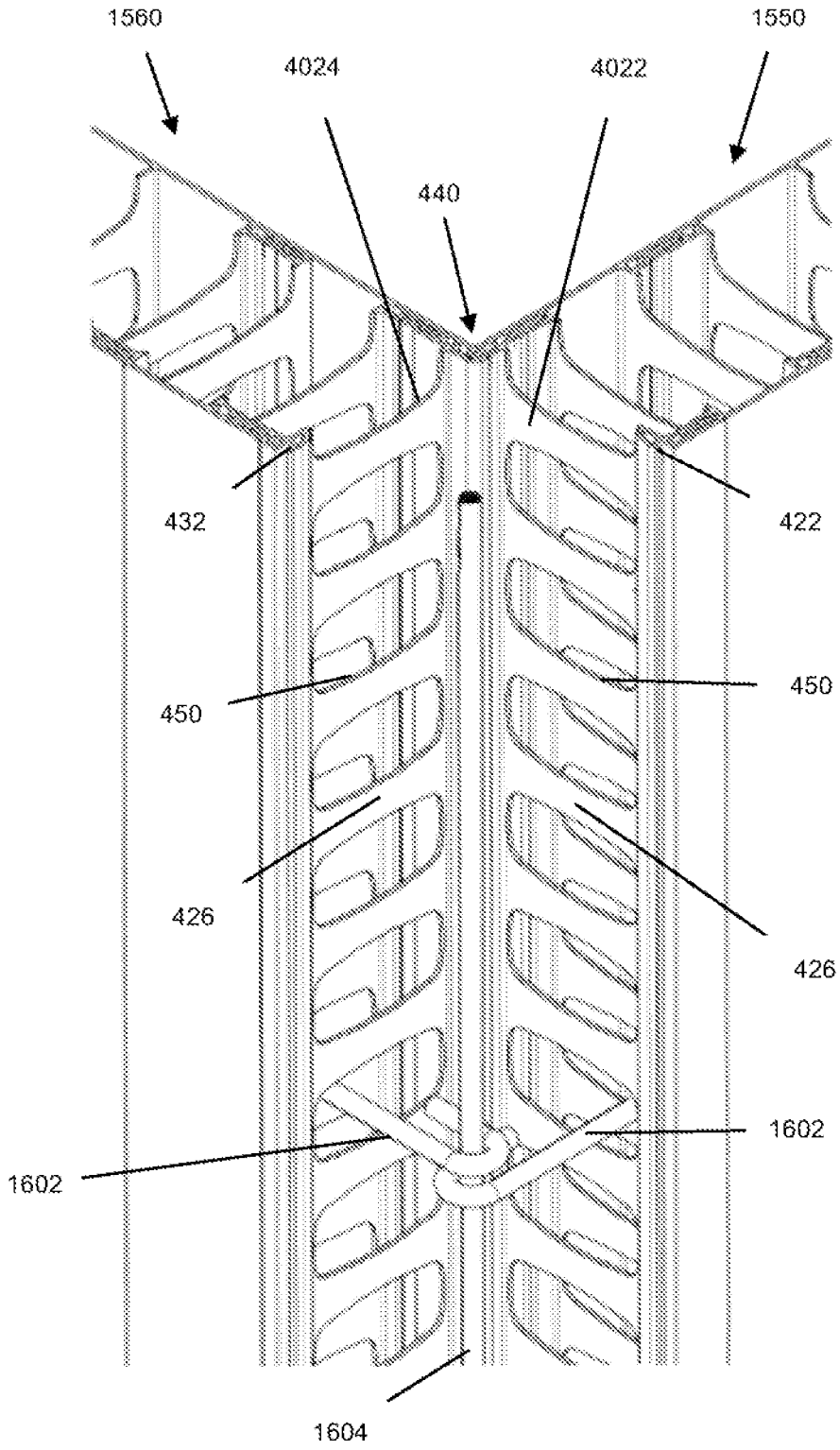
FIG. 16 is a perspective view of a first formwork-defining counterpart of the formwork of FIG. 13 interconnecting a plurality of formworks.

In operation, to install two wall portions interconnected by a formwork 400 at a corner, the counterpart of the formwork 400 representative of the inner corner, for example, the first formwork-defining counterpart 402, as depicted in FIG. 16, is installed. Then, other formworks, such as formwork 200 and formwork 300, are connectible with the first formwork-defining counterpart 402, as described with respect to the connections between the first formwork 100 and the second formwork 200 and between the first formwork 100 and the third formwork 300, to obtain the first wall portion 1550 and the second wall portion 1560.

At this point, as depicted in FIG. 16, the first formwork-defining counterpart 402, the first wall portion 1550, and the second wall portion 1560 are installed, but the counterpart of the formwork 400 representative of the outer formwork, for example, the second formwork-defining counterpart 404, is not yet connected to the first formwork-defining counterpart 402. Accordingly, the slurry-receiving structure 406, such as the aperture 408 and the formwork-defined internal space 410, and building components therein, may be accessed to complete additional work, or may be inspected, prior to completion of installation of the formwork 400 by connecting the second formwork-defining counterpart 404 to the first formwork-defining counterpart 402.

As depicted in FIG. 16, in some embodiments, for example, at least a portion of horizontal rebars 1602 extending through the wall portion 1550 and the wall portion 1560, and a vertical rebar 1604, are received in the formwork-defined internal space 410, with the horizontal rebars 1602 connected to, for example, hooked to, the vertical rebar 1604. As depicted in FIG. 16, in some embodiments, for example, the formworks 100, 200, 300, and 400 include one or more coring or apertures 450 defined on one or more walls of the formworks, for example, the first end wall 106 and the second end wall 112 of the formworks, such that the horizontal rebar 1602 is extendible through the formworks. Accordingly, prior to connection of the second formwork-defining counterpart 404 to the first formwork-defining counterpart 402, the slurry-receiving structure 406 is exposed and accessible, such that additional work may be completed, or inspection may be completed, for example, inspection of the horizontal rebars 1602, the vertical rebar 1604, and the connection between the horizontal rebars 1602 and the vertical rebar 1604.

After the additional work is completed or after the inspection is completed, the second formwork-defining counterpart 404 is connected to the first formwork-defining counterpart 402, for example, with the connecting system 440, such that the formwork 400 is obtained. With the formwork 400 obtained, in some embodiments, for example, two wall portions interconnected by a formwork 400 at a corner is installed. In some embodiments, for example, the formwork 400 is braced, for example, with lumber or metal, before slurry is poured into the slurry-receiving structure 406 of the formwork 400.

In some embodiments, for example, the formworks 100, 200, 300, and 400 are manufactured with one or more types of plastic, for example, rigid polyvinyl chloride, flexible polyvinyl chloride, or a combination thereof.

In some embodiments, for example, the formworks 100, 200, 300, and 400 are manufactured by extrusion, for example, cold extrusion.

The formwork 100 includes the formwork-defined first connection system counterpart 150A and the formwork-defined second connection system counterpart 150B that are configured to engage with the first connection system counterpart 270A and the second connection system counterpart 270B of the second formwork 200, wherein the first connection system counterpart 270A and the second connection system counterpart 270B of the second formwork 200 has the same features and are identical to the formwork-defined third connection system counterpart 170A and the formwork-defined fourth connection system counterpart 170B of the first formwork 100. As described herein and depicted in FIG. 1, the formwork-defined third connection system counterpart 170A and the formwork-defined fourth connection system counterpart 170B of the first formwork 100 are disposed on the second end wall 112 that is opposite the first end wall 106, on which the formwork-defined first connection system counterpart 150A and the formwork-defined second connection system counterpart 150B. Such a disposition of the formwork-defined first connection system counterpart 150A and the formwork-defined second connection system counterpart 150B and the formwork-defined third connection system counterpart 170A and the formwork-defined fourth connection system counterpart 170B on the formwork 100 allows for a sequence of connected formworks or a wall portion of formworks extending along one direction to be defined by a plurality of formworks 100, without the need for another formwork. As such, only one design of formwork, namely the formwork 100, may be manufactured to assemble the sequence of connected formworks or a wall portion of formworks extending along one direction, which may reduce the manufacturing cost of the sequence of connected formworks.

The preceding discussion provides many example embodiments. Although each embodiment represents a single combination of inventive elements, other examples may include all suitable combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations could be made herein.

Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

What is claimed is:

1. A plastic formwork comprising:

a slurry-receiving structure, wherein:

the slurry-receiving structure defines an aperture and a formwork-defined internal space, and;

the aperture and the formwork-defined internal space are co-operatively configured such that a slurry is receivable within the formwork-defined internal space via the aperture;

a formwork-defined first connection system counterpart, extending from the slurry-receiving structure, and including an interface portion that is supported by a substrate portion, wherein the material of the interface portion is softer than the material of the substrate portion, and further wherein the interface portion includes a sealing bead that extends away from the substrate portion, the sealing bead including a rounded portion; and a formwork-defined second connection system counterpart, extending from the slurry-receiving structure, and including an interface portion that is supported by a substrate portion, wherein the material of the interface portion is softer than the material of the substrate portion, and further wherein the interface portion includes a sealing bead that extends away from the substrate portion, the sealing bead including a rounded portion;

wherein:

the formwork is configured to define a first formwork, the first formwork is connectible to a second formwork via a first connection system and a second connection system for defining an obtained aperture and an obtained internal space, wherein the obtained aperture and the obtained internal space are co-operatively configured such that a slurry is receivable within the obtained internal space via the obtained aperture;

the formwork-defined first connection system counterpart is configured for interlocking engagement with a first connection system counterpart of the second formwork, the first connection system including the formwork-defined first connection system counterpart and the first connection system counterpart of the second formwork, such that, while the formwork-defined first connection system counterpart is disposed in interlocking engagement with the first connection system counterpart of the second formwork, the rounded portion of the sealing bead of the formwork-defined first connection system counterpart sealingly engages the first connection system counterpart of the second formwork, such that a sealed interface is obtained between the formwork-defined first connection system counterpart and the first connection system counterpart of the second formwork;

the formwork-defined second connection system counterpart is configured for interlocking engagement with a second connection system counterpart of the second formwork, the second connection system including the formwork-defined second connection system counterpart and the second connection system counterpart of the second formwork, such that, while the formwork-defined second connection system counterpart is disposed in interlocking engagement with the second connection system counterpart of the second formwork, the rounded portion of the sealing bead of the formwork-defined second connection system counterpart sealingly engages the second connection system counterpart of the second formwork, such that a sealed interface is obtained between the formwork-defined second connection system counterpart and the second connection system counterpart of the second formwork; and while the first formwork is connected to the second formwork via the first connection system and the second connection system, and the slurry is received within the obtained internal space, a force applied by the slurry to the first connection system and the second connection system strengthens (i) the sealed interface between the formwork-defined first connection system counterpart and the first connection system counterpart of the second formwork, and (ii) the sealed interface between the formwork-defined second connection system counterpart and the second connection system counterpart of the second formwork.

2. The plastic formwork of claim 1, wherein the interface portion has a first compressive modulus, and the substrate portion has a second compressive modulus that is greater than the first compressive modulus.

3. The plastic formwork of claim 1, wherein the interface portion has a first shore hardness, and the substrate portion has a second shore hardness that is greater than the first shore hardness.

4. The plastic formwork of claim 1, wherein:

the sealing bead of the formwork-defined first connection system counterpart is deformable to obtain the sealed interface between the formwork-defined first connection system counterpart and the first connection system counterpart of the second formwork; and the sealing bead of the formwork-defined second connection system counterpart is deformable to obtain the sealed interface between the formwork-defined second connection system counterpart and the second connection system counterpart of the second formwork.

5. The plastic formwork of claim 1, wherein the formwork-defined internal space has a volume of at least 0.005 $m^3$.

6. The plastic formwork of claim 1, wherein the obtained internal space has a volume of at least 0.005 $m^3$.

7. The plastic formwork of claim 1, wherein:

the obtained aperture is a first obtained aperture, and the obtained internal space is a first obtained internal space;

the first formwork further comprising:

a formwork-defined third connection system counterpart, extending from the slurry-receiving structure, and including an interlocking portion;

a formwork-defined fourth connection system counterpart, extending from the slurry-receiving structure, and including an interlocking portion;

wherein:

the first formwork is connectible to a third formwork via a third connection system and a fourth connection system for defining a second obtained aperture and a second obtained internal space, wherein the second obtained aperture and the second obtained internal space are co-operatively configured such that a slurry is receivable within the second obtained internal space via the second obtained aperture;

the formwork-defined third connection system counterpart is configured for interlocking engagement with a third connection system counterpart of the third formwork, the third connection system including the formwork-defined third connection system counterpart and the third connection system counterpart of the third formwork;

the formwork-defined fourth connection system counterpart is configured for interlocking engagement with a fourth connection system counterpart of the third formwork, the fourth connection system including the formwork-defined fourth connection system counterpart and the fourth connection system counterpart of the third formwork.

8. The plastic formwork of claim 7, wherein the first formwork is configured to cooperate with the third formwork such that:

while the formwork-defined third connection system counterpart is disposed in interlocking engagement with the third connection system counterpart of the third formwork, the formwork-defined third connection system counterpart sealingly engages the third connection system counterpart of the third formwork such that a sealed interface is obtained between the formwork-defined third connection system counterpart and the third connection system counterpart of the third formwork; and while the formwork-defined fourth connection system counterpart is disposed in interlocking engagement with the fourth connection system counterpart of the third formwork, the formwork-defined fourth connection system counterpart sealingly engages the fourth connection system counterpart of the third formwork such that a sealed interface is obtained between the formwork-defined fourth connection system counterpart and the fourth connection system counterpart of the third formwork.

9. The plastic formwork of claim 7, wherein:

the formwork-defined first connection system counterpart and the formwork-defined second connection system counterpart extend from a first wall of the first formwork; and the formwork-defined third connection system counterpart and the formwork-defined fourth connection system counterpart extend from a second wall of the first formwork that is disposed opposite the first wall of the first formwork.

10. The plastic formwork of claim 7, wherein:

the formwork-defined first connection system counterpart and the formwork-defined second connection system counterpart extend from a first wall of the first formwork; and the formwork-defined third connection system counterpart and the formwork-defined fourth connection system counterpart extend from a second wall of the first formwork that is disposed adjacent the first wall of the first formwork.

11. A plastic formwork comprising:

a slurry-receiving structure wherein:

the slurry-receiving structure defines an aperture and a formwork-defined internal space, and;

the aperture and the formwork-defined internal space are co-operatively configured such that a slurry is receivable within the formwork-defined internal space via the aperture;

a formwork-defined first connection system counterpart, extending from the slurry-receiving structure, and including an interface portion that is supported by a substrate portion, wherein the material of the interface portion is deformable, relative to the material of the substrate portion, in response to connection of the first formwork with a second formwork, and further wherein the interface portion includes a sealing bead that extends away from the substrate portion, the sealing bead including a rounded portion; and a formwork-defined second connection system counterpart, extending from the slurry-receiving structure, and including an interface portion that is supported by a substrate portion, wherein the material of the interface portion is deformable, relative to the material of the substrate portion, in response to connection of the first formwork with the second formwork, and further wherein the interface portion includes a sealing bead that extends away from the substrate portion, the sealing bead including a rounded portion;

wherein:

the formwork is configured to define a first formwork, the first formwork is connectible to the second formwork via a first connection system and a second connection system for defining an obtained aperture and an obtained internal space, wherein the obtained aperture and the obtained internal space are co-operatively configured such that a slurry is receivable within the obtained internal space via the obtained aperture;

the formwork-defined first connection system counterpart is configured for interlocking engagement with a first connection system counterpart of the second formwork, the first connection system including the formwork-defined first connection system counterpart and the first connection system counterpart of the second formwork, such that, while the formwork-defined first connection system counterpart is disposed in interlocking engagement with the first connection system counterpart of the second formwork, the rounded portion of the sealing bead of the formwork-defined first connection system counterpart sealingly engages the first connection system counterpart of the second formwork, such that a sealed interface is obtained between the formwork-defined first connection system counterpart and the first connection system counterpart of the second formwork;

the formwork-defined second connection system counterpart is configured for interlocking engagement with a second connection system counterpart of the second formwork, the second connection system including the formwork-defined second connection system counterpart and the second connection system counterpart of the second formwork, such that, while the formwork-defined second connection system counterpart is disposed in interlocking engagement with the second connection system counterpart of the second formwork, the rounded portion of the sealing bead of the formwork-defined second connection system counterpart sealingly engages the second connection system counterpart of the second formwork, such that a sealed interface is obtained between the formwork-defined second connection system counterpart and the second connection system counterpart of the second formwork; and the first formwork is configured to co-operate with the second formwork such that, while the first formwork is connected to the second formwork via the first connection system and the second connection system, and the slurry is received within the obtained internal space, a force applied by the slurry to the first connection system and the second connection system strengthens (i) the sealed interface between the formwork-defined first connection system counterpart and the first connection system counterpart of the second formwork, and (ii) the sealed interface between the formwork-defined second connection system counterpart and the second connection system counterpart of the second formwork.

12. A plastic formwork comprising:

a first formwork-defining counterpart and a second formwork-defining counterpart, wherein the first formwork-defining counterpart and the second formwork-defining counterpart are connectible to obtain the first formwork for defining a slurry-receiving structure, wherein:

the slurry-receiving structure defines an aperture and a formwork-defined internal space, and;

the aperture and the formwork-defined internal space are co-operatively configured such that a slurry is receivable within the formwork-defined internal space via the aperture;

a formwork-defined first connection system counterpart, extending from the first formwork-defining counterpart, and including an interface portion that is supported by a substrate portion, wherein the material of the interface portion is softer than the material of the substrate portion, and further wherein the interface portion includes a sealing bead that extends away from the substrate portion, the sealing bead including a rounded portion; and a formwork-defined second connection system counterpart, extending from the first formwork-defining counterpart, and including an interface portion that is supported by a substrate portion, wherein the material of the interface portion is softer than the material of the substrate portion, and further wherein the interface portion includes a rounded portion that extends away from the substrate portion;

wherein:

the formwork is configured to define a first formwork, the first formwork is connectible to a second formwork via a first connection system and a second connection system for defining an obtained aperture and an obtained internal space, wherein the obtained aperture and the obtained internal space are co-operatively configured such that a slurry is receivable within the obtained internal space via the obtained aperture;

the formwork-defined first connection system counterpart is configured for interlocking engagement with a first connection system counterpart of the second formwork, the first connection system including the formwork-defined first connection system counterpart and the first connection system counterpart of the second formwork, such that, while the formwork-defined first connection system counterpart is disposed in interlocking engagement with the first connection system counterpart of the second formwork, the rounded portion of the sealing bead of the formwork-defined first connection system counterpart sealingly engages the first connection system counterpart of the second formwork such that a sealed interface is obtained between the formwork-defined first connection system counterpart and the first connection system counterpart of the second formwork;

the formwork-defined second connection system counterpart is configured for interlocking engagement with a second connection system counterpart of the second formwork, the second connection system including the formwork-defined second connection system counterpart and the second connection system counterpart of the second formwork, such that, while the formwork-defined second connection system counterpart is disposed in interlocking engagement with the second connection system counterpart of the second formwork, the rounded portion of the sealing bead of the formwork-defined second connection system counterpart sealingly engages the second connection system counterpart of the second formwork such that a sealed interface is obtained between the formwork-defined second connection system counterpart and the second connection system counterpart of the second formwork; and the first formwork is configured to cooperate with the second formwork such that, while the first formwork is connected to the second formwork via the first connection system and the second connection system, and the slurry is received within the obtained internal space, a force applied by the slurry to the first connection system and the second connection system strengthens (i) the sealed interface between the formwork-defined first connection system counterpart and the first connection system counterpart of the second formwork, and (ii) the sealed interface between the formwork-defined second connection system counterpart and the second connection system counterpart of the second formwork.

13. The plastic formwork of claim 12, wherein:

the first formwork-defining counterpart includes a first counterpart and a second counterpart, wherein the first counterpart and the second counterpart of the first formwork defining counterpart are connectible to obtain the first formwork-defining counterpart, such that a cavity-defining surface portion of the first formwork-defining counterpart is obtained, wherein the cavity-defining surface portion of the first formwork-defining counterpart and a cavity-defining surface portion of the second formwork-defining counterpart are co-operatively configured to define the slurry-receiving structure while the first formwork-defining counterpart and the second formwork-defining counterpart are connected.

14. The plastic formwork of claim 13, wherein:

the formwork-defined first connection system counterpart extends from the first counterpart of the first formwork-defining counterpart; and the formwork-defined second connection system counterpart extends from the first counterpart of the first formwork-defining counterpart.

15. The plastic formwork of claim 12, wherein:

the obtained aperture is a first obtained aperture, and the obtained internal space is a first obtained internal space;

the first formwork further comprising:

a formwork-defined third connection system counterpart, extending from the first formwork-defining counterpart, and including an interlocking portion;

a formwork-defined fourth connection system counterpart, extending from the first formwork-defining counterpart, and including an interlocking portion;

wherein:

the first formwork is connectible to a third formwork via a third connection system and a fourth connection system for defining a second obtained aperture and a second obtained internal space, wherein the second obtained aperture and the second obtained internal space are co-operatively configured such that a slurry is receivable within the second obtained internal space via the second obtained aperture;

the formwork-defined third connection system counterpart is configured for interlocking engagement with a third connection system counterpart of the third formwork, the third connection system including the formwork-defined third connection system counterpart and the third connection system counterpart of the third formwork;

the formwork-defined fourth connection system counterpart is configured for interlocking engagement with a fourth connection system counterpart of the third formwork, the fourth connection system including the formwork-defined fourth connection system counterpart and the fourth connection system counterpart of the third formwork.

16. The plastic formwork of claim 15, wherein the first formwork is configured to cooperate with the third formwork such that:

while the formwork-defined third connection system counterpart is disposed in interlocking engagement with the third connection system counterpart of the third formwork, the formwork-defined third connection system counterpart sealingly engages the third connection system counterpart of the third formwork, such that a sealed interface is obtained between the formwork-defined third connection system counterpart and the third connection system counterpart of the third formwork; and while the formwork-defined fourth connection system counterpart is disposed in interlocking engagement with the fourth connection system counterpart of the third formwork, the formwork-defined fourth connection system counterpart sealingly engages the fourth connection system counterpart of the third formwork such that a sealed interface is obtained between the formwork-defined fourth connection system counterpart and the fourth connection system counterpart of the third formwork.

17. The plastic formwork of claim 15, wherein:

the first formwork-defining counterpart includes a first counterpart and a second counterpart, wherein the first counterpart and the second counterpart of the first formwork defining counterpart are connectible to obtain the first formwork-defining counterpart, such that a cavity-defining surface portion of the first formwork-defining counterpart is obtained, wherein the cavity-defining surface portion of the first formwork-defining counterpart and a cavity-defining surface portion of the second formwork-defining counterpart are co-operatively configured to define the slurry-receiving structure while the first formwork-defining counterpart and the second formwork-defining counterpart are connected.

18. The plastic formwork of claim 17, wherein:

the formwork-defined first connection system counterpart extends from the first counterpart of the first formwork-defining counterpart;

the formwork-defined second connection system counterpart extends from the first counterpart of the first formwork-defining counterpart;

the formwork-defined third connection system counterpart extends from the second counterpart of the first formwork-defining counterpart; and the formwork-defined fourth connection system counterpart extends from the second counterpart of the first formwork-defining counterpart.

19. The plastic formwork of claim 15, wherein:

the first formwork, the second formwork, and the third formwork are co-operatively configured such that the second formwork and the third formwork are interconnectible via the first formwork, wherein, while the second formwork and the third formwork are interconnected via the first formwork, the second formwork and the third formwork are disposed in a perpendicular relationship.

20. The plastic formwork of claim 12, wherein:

the first formwork is a corner formwork; and the first formwork-defining counterpart defines an inner corner of the corner formwork, and the second formwork-defining counterpart defines an outer corner of the corner formwork.

21. The plastic formwork of claim 1, wherein:

the force applied by the slurry to the first connection system is applied to the first connection system counterpart of the second formwork; and the force applied by the slurry to the second connection system is applied to the second connection system counterpart of the second formwork.

22. The plastic formwork of claim 11, wherein:

the force applied by the slurry to the first connection system is applied to the first connection system counterpart of the second formwork; and the force applied by the slurry to the second connection system is applied to the second connection system counterpart of the second formwork.

23. The plastic formwork of claim 12, wherein:

the force applied by the slurry to the first connection system is applied to the first connection system counterpart of the second formwork; and the force applied by the slurry to the second connection system is applied to the second connection system counterpart of the second formwork.

* * * * *